US006945075B2

(12) United States Patent
Wilkinson et al.

(10) Patent No.: US 6,945,075 B2
(45) Date of Patent: Sep. 20, 2005

(54) NATURAL GAS LIQUEFACTION

(75) Inventors: John D. Wilkinson, Midland, TX (US); Hank M. Hudson, Midland, TX (US); Kyle T. Ceullar, Katy, TX (US)

(73) Assignee: ElkCorp, Dallas, TX (US)

( * ) Notice: Subject to any disclaimer, the term of this patent is extended or adjusted under 35 U.S.C. 154(b) by 329 days.

(21) Appl. No.: 10/278,610

(22) Filed: Oct. 23, 2002

(65) Prior Publication Data

US 2004/0079107 A1 Apr. 29, 2004

(51) Int. Cl.[7] ..... F25J 3/00; F25J 1/00
(52) U.S. Cl. ..... 62/620; 62/613; 62/621
(58) Field of Search ..... 62/620, 621, 627, 62/613, 611

(56) References Cited

U.S. PATENT DOCUMENTS

| | | | | |
|---|---|---|---|---|
| 2,952,984 | A | 9/1960 | Marshall | 62/622 |
| 3,292,380 | A | 12/1966 | Bucklin | 62/20 |
| 3,837,172 | A | 9/1974 | Markbreiter et al. | 62/621 |
| 4,140,504 | A | 2/1979 | Campbell et al. | 62/621 |
| 4,157,904 | A | 6/1979 | Campbell et al. | 62/623 |
| 4,171,964 | A | 10/1979 | Campbell et al. | 62/621 |
| 4,185,978 | A | 1/1980 | McGalliard et al. | 62/634 |
| 4,251,249 | A | 2/1981 | Gulsby | 62/621 |
| 4,278,457 | A | 7/1981 | Campbell et al. | 62/621 |
| 4,445,917 | A | 5/1984 | Chiu | 62/625 |

(Continued)

FOREIGN PATENT DOCUMENTS

WO 01/88447 A1 11/2001

OTHER PUBLICATIONS

U.S. Appl. No. 09/677,220, filed Oct. 2000, Spec. & Figs.

Price, Brian C., "LNG Production for Peak Shaving Operations", Proceedings of the Seventy–Eighth Annual Convention of the Gas Processors Association, pp. 273–280, Nashville, Tennessee, Mar. 1–3, 1999.

Co–pending U.S. Appl. No. 10/161,780, filed Jun. 4, 2002.

Finn, Adrian J., Grant L. Johnson, and Terry R. Tomlinson, "LNG Technology for Offshore and Mid–Scale Plants", Proceedings of the Seventy–Ninth Annual Convention of the Gas Processors Association, pp. 429–450, Atlanta, Georgia, Mar. 13–15, 2000.

Kikkawa, Yoshitsugi, Masaaki Ohishi, and Noriyoshi Nozawa, "Optimize the Power System of Baseload LNG Plant" Proceedings of the Eightieth Annual Convention of the Gas Processors Association, San Antonio, Texas, Mar. 12–14, 2001.

*Primary Examiner*—William C. Doerrler
(74) *Attorney, Agent, or Firm*—Fitzpatrick, Cella, Harper & Scinto

(57) ABSTRACT

A process for liquefying natural gas in conjunction with producing a liquid stream containing predominantly hydrocarbons heavier than methane is disclosed. In the process, the natural gas stream to be liquefied is partially cooled, expanded to an intermediate pressure, and supplied to a distillation column. The bottom product from this distillation column preferentially contains the majority of any hydrocarbons heavier than methane that would otherwise reduce the purity of the liquefied natural gas. The residual gas stream from the distillation column is compressed to a higher intermediate pressure, cooled under pressure to condense it, and then expanded to low pressure to form the liquefied natural gas stream.

78 Claims, 10 Drawing Sheets

U.S. PATENT DOCUMENTS

| | | | | | |
|---|---|---|---|---|---|
| 4,519,824 | A | | 5/1985 | Huebel | 62/621 |
| 4,525,185 | A | | 6/1985 | Newton | 62/612 |
| 4,545,795 | A | | 10/1985 | Liu et al. | 62/613 |
| 4,600,421 | A | | 7/1986 | Kummann | 62/621 |
| 4,617,039 | A | | 10/1986 | Buck | 62/621 |
| 4,687,499 | A | | 8/1987 | Aghili | 62/621 |
| 4,689,063 | A | | 8/1987 | Paradowski et al. | 62/627 |
| 4,690,702 | A | | 9/1987 | Paradowski et al. | 62/621 |
| 4,707,170 | A | * | 11/1987 | Ayres et al. | 62/627 |
| 4,710,214 | A | | 12/1987 | Sharma et al. | 62/621 |
| 4,755,200 | A | | 7/1988 | Liu et al. | 62/612 |
| 4,851,020 | A | | 7/1989 | Montgomery, IV | 62/621 |
| 4,854,955 | A | | 8/1989 | Campbell et al. | 62/621 |
| 4,869,740 | A | | 9/1989 | Campbell et al. | 62/621 |
| 4,889,545 | A | | 12/1989 | Campbell et al. | 62/621 |
| 4,895,584 | A | | 1/1990 | Buck et al. | 62/621 |
| RE33,408 | E | | 10/1990 | Khan et al. | 62/29 |
| 5,114,451 | A | | 5/1992 | Rambo et al. | 62/623 |
| 5,275,005 | A | | 1/1994 | Campbell et al. | 62/621 |
| 5,291,736 | A | | 3/1994 | Paradowski | 62/613 |
| 5,363,655 | A | | 11/1994 | Kikkawa et al. | 62/613 |
| 5,365,740 | A | | 11/1994 | Kikkawa et al. | 62/613 |
| 5,555,748 | A | * | 9/1996 | Campbell et al. | 62/621 |
| 5,566,554 | A | | 10/1996 | Vijayaraghavan et al. | 62/621 |
| 5,568,737 | A | * | 10/1996 | Campbell et al. | 62/621 |
| 5,600,969 | A | | 2/1997 | Low | 62/622 |
| 5,615,561 | A | * | 4/1997 | Houshmand et al. | 62/611 |
| 5,651,269 | A | | 7/1997 | Prevost et al. | 62/613 |
| 5,755,114 | A | | 5/1998 | Foglietta | 62/618 |
| 5,755,115 | A | | 5/1998 | Manley | 62/620 |
| 5,771,712 | A | | 6/1998 | Campbell et al. | 62/621 |
| 5,799,507 | A | | 9/1998 | Wilkinson et al. | 62/621 |
| 5,881,569 | A | | 3/1999 | Campbell et al. | 62/621 |
| 5,890,378 | A | | 4/1999 | Rambo et al. | 62/621 |
| 5,893,274 | A | | 4/1999 | Nagelvoort et al. | 62/613 |
| 5,983,664 | A | * | 11/1999 | Campbell et al. | 62/621 |
| 6,014,869 | A | | 1/2000 | Elion et al. | 62/621 |
| 6,023,942 | A | * | 2/2000 | Thomas et al. | 62/613 |
| 6,053,007 | A | | 4/2000 | Victory et al. | 62/619 |
| 6,062,041 | A | | 5/2000 | Kikkawa et al. | 62/613 |
| 6,116,050 | A | * | 9/2000 | Yao et al. | 62/630 |
| 6,119,479 | A | | 9/2000 | Roberts et al. | 62/612 |
| 6,125,653 | A | | 10/2000 | Shu et al. | 62/622 |
| 6,182,469 | B1 | * | 2/2001 | Campbell et al. | 62/621 |
| 6,250,105 | B1 | | 6/2001 | Kimble | 62/613 |
| 6,269,655 | B1 | | 8/2001 | Roberts et al. | 62/612 |
| 6,272,882 | B1 | | 8/2001 | Hodges et al. | 62/613 |
| 6,308,531 | B1 | | 10/2001 | Roberts et al. | 62/611 |
| 6,324,867 | B1 | | 12/2001 | Fanning et al. | 62/613 |
| 6,336,344 | B1 | * | 1/2002 | O'Brien | 62/627 |
| 6,347,532 | B1 | | 2/2002 | Agrawal et al. | 62/612 |
| 6,363,744 | B2 | | 4/2002 | Finn et al. | 62/621 |
| 6,367,286 | B1 | * | 4/2002 | Price | 62/613 |
| 6,526,777 | B1 | * | 3/2003 | Campbell et al. | 62/621 |
| 6,742,358 | B2 | | 6/2004 | Wilkinson et al. | 62/613 |
| 2003/0158458 | A1 | | 8/2003 | Prim | 585/800 |
| 2004/0079107 | A1 | | 4/2004 | Wilkinson et al. | 62/611 |

* cited by examiner

NATURAL GAS LIQUEFACTION

BACKGROUND OF THE INVENTION

This invention relates to a process for processing natural gas or other methane-rich gas streams to produce a liquefied natural gas (LNG) stream that has a high methane purity and a liquid stream containing predominantly hydrocarbons heavier than methane.

Natural gas is typically recovered from wells drilled into underground reservoirs. It usually has a major proportion of methane, i.e., methane comprises at least 50 mole percent of the gas. Depending on the particular underground reservoir, the natural gas also contains relatively lesser amounts of heavier hydrocarbons such as ethane, propane, butanes, pentanes and the like, as well as water, hydrogen, nitrogen, carbon dioxide, and other gases.

Most natural gas is handled in gaseous form. The most common means for transporting natural gas from the wellhead to gas processing plants and thence to the natural gas consumers is in high pressure gas transmission pipelines. In a number of circumstances, however, it has been found necessary and/or desirable to liquefy the natural gas either for transport or for use. In remote locations, for instance, there is often no pipeline infrastructure that would allow for convenient transportation of the natural gas to market. In such cases, the much lower specific volume of LNG relative to natural gas in the gaseous state can greatly reduce transportation costs by allowing delivery of the LNG using cargo ships and transport trucks.

Another circumstance that favors the liquefaction of natural gas is for its use as a motor vehicle fuel. In large metropolitan areas, there are fleets of buses, taxi cabs, and trucks that could be powered by LNG if there were an economic source of LNG available. Such LNG-fueled vehicles produce considerably less air pollution due to the clean-burning nature of natural gas when compared to similar vehicles powered by gasoline and diesel engines which combust higher molecular weight hydrocarbons. In addition, if the LNG is of high purity (i.e., with a methane purity of 95 mole percent or higher), the amount of carbon dioxide (a "greenhouse gas") produced is considerably less due to the lower carbon:hydrogen ratio for methane compared to all other hydrocarbon fuels.

The present invention is generally concerned with the liquefaction of natural gas while producing as a co-product a liquid stream consisting primarily of hydrocarbons heavier than methane, such as natural gas liquids (NGL) composed of ethane, propane, butanes, and heavier hydrocarbon components, liquefied petroleum gas (LPG) composed of propane, butanes, and heavier hydrocarbon components, or condensate composed of butanes and heavier hydrocarbon components. Producing the co-product liquid stream has two important benefits: the LNG produced has a high methane purity, and the co-product liquid is a valuable product that may be used for many other purposes. A typical analysis of a natural gas stream to be processed in accordance with this invention would be, in approximate mole percent, 84.2% methane, 7.9% ethane and other $C_2$ components, 4.9% propane and other $C_3$ components, 1.0% iso-butane, 1.1% normal butane, 0.8% pentanes plus, with the balance made up of nitrogen and carbon dioxide. Sulfur containing gases are also sometimes present.

There are a number of methods known for liquefying natural gas. For instance, see Finn, Adrian J., Grant L. Johnson, and Terry R. Tomlinson, "LNG Technology for Offshore and Mid-Scale Plants", Proceedings of the Seventy-Ninth Annual Convention of the Gas Processors Association, pp. 429–450, Atlanta, Ga., Mar. 13–15, 2000 and Kikkawa, Yoshitsugi, Masaaki Ohishi, and Noriyoshi Nozawa, "Optimize the Power System of Baseload LNG Plant", Proceedings of the Eightieth Annual Convention of the Gas Processors Association, San Antonio, Tex., Mar. 12–14, 2001 for surveys of a number of such processes. U.S. Pat. Nos. 4,445,917; 4,525,185; 4,545,795; 4,755,200; 5,291,736; 5,363,655; 5,365,740; 5,600,969; 5,615,561; 5,651,269; 5,755,114; 5,893,274; 6,014,869; 6,062,041; 6,119,479; 6,125,653; 6,250,105 B1; 6,269,655 B1; 6,272,882 B1; 6,308,531 B1; 6,324,867 B1; 6,347,532 B1; and our co-pending U.S. patent application Ser. No. 10/161,780 filed Jun. 4, 2002 also describe relevant processes. These methods generally include steps in which the natural gas is purified (by removing water and troublesome compounds such as carbon dioxide and sulfur compounds), cooled, condensed, and expanded. Cooling and condensation of the natural gas can be accomplished in many different manners. "Cascade refrigeration" employs heat exchange of the natural gas with several refrigerants having successively lower boiling points, such as propane, ethane, and methane. As an alternative, this heat exchange can be accomplished using a single refrigerant by evaporating the refrigerant at several different pressure levels. "Multi-component refrigeration" employs heat exchange of the natural gas with one or more refrigerant fluids composed of several refrigerant components in lieu of multiple single-component refrigerants. Expansion of the natural gas can be accomplished both isenthalpically (using Joule-Thomson expansion, for instance) and isentropically (using a work-expansion turbine, for instance).

Regardless of the method used to liquefy the natural gas stream, it is common to require removal of a significant fraction of the hydrocarbons heavier than methane before the methane-rich stream is liquefied. The reasons for this hydrocarbon removal step are numerous, including the need to control the heating value of the LNG stream, and the value of these heavier hydrocarbon components as products in their own right. Unfortunately, little attention has been focused heretofore on the efficiency of the hydrocarbon removal step.

In accordance with the present invention, it has been found that careful integration of the hydrocarbon removal step into the LNG liquefaction process can produce both LNG and a separate heavier hydrocarbon liquid product using significantly less energy than prior art processes. The present invention, although applicable at lower pressures, is particularly advantageous when processing feed gases in the range of 400 to 1500 psia [2,758 to 10,342 kPa(a)] or higher.

For a better understanding of the present invention, reference is made to the following examples and drawings. Referring to the drawings.

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the International System of Units (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour. The production rates reported as pounds per hour (Lb/Hr) correspond to the stated molar flow rates in pound moles per hour. The production rates reported as kilograms per hour (kg/Hr) correspond to the stated molar flow rates in kilogram moles per hour.

DESCRIPTION OF THE INVENTION

Figure 1:
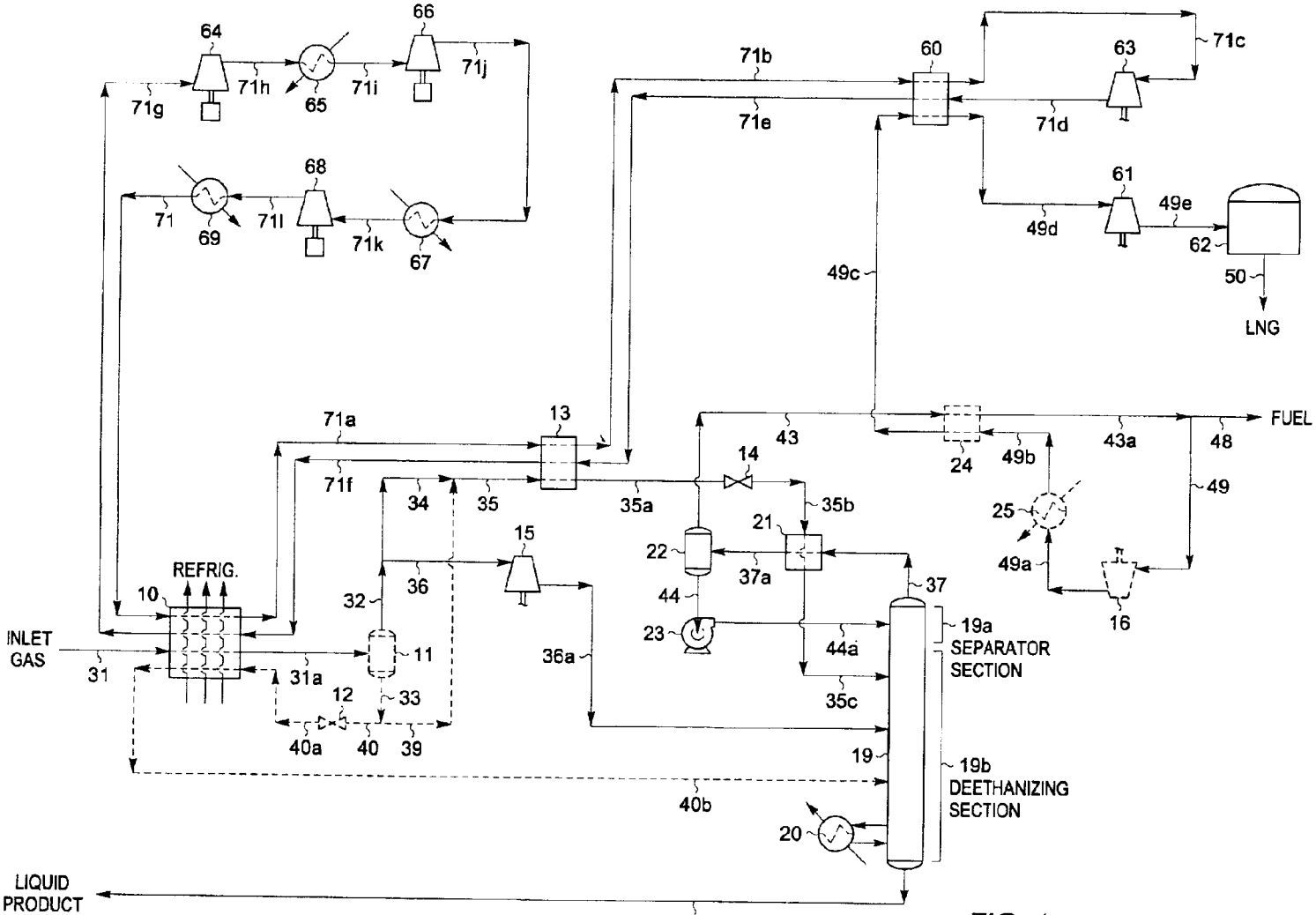
FIG. 1 is a flow diagram of a natural gas liquefaction plant adapted for co-production of LPG in accordance with the present invention.

Referring now to FIG. 1, we begin with an illustration of a process in accordance with the present invention where it is desired to produce an LPG co-product containing the majority of the propane and heavier components in the natural gas feed stream. In this simulation of the present invention, inlet gas enters the plant at 90° F. [32° C.] and 1285 psia [8,860 kPa(a)] as stream 31. If the inlet gas contains a concentration of carbon dioxide and/or sulfur compounds which would prevent the product streams from meeting specifications, these compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream 31 is cooled in heat exchanger 10 by heat exchange with refrigerant streams and flashed separator liquids at −14° F. [−26° C.] (stream 40*a*). Note that in all cases heat exchanger 10 is representative of either a multitude of individual heat exchangers or a single multi-pass heat exchanger, or any combination thereof. (The decision as to whether to use more than one heat exchanger for the indicated cooling services will depend on a number of factors including, but not limited to, inlet gas flow rate, heat exchanger size, stream temperatures, etc.) The cooled stream 31*a* enters separator 11 at 23° F. [−5° C.] and 1278 psia [8,812 kPa(a)] where the vapor (stream 32) is separated from the condensed liquid (stream 33).

The vapor (stream 32) from separator 11 is divided into two streams, 34 and 36, with stream 34 containing about 42% of the total vapor. Some circumstances may favor combining stream 34 with some portion of the condensed liquid (stream 39) to form stream 35, but in this simulation there is no flow in stream 39. Combined stream 35 passes through heat exchanger 13 in heat exchange relation with refrigerant stream 71*e*, resulting in cooling and substantial condensation of stream 35*a*. The substantially condensed stream 35*a* at −90° F. [−68° C.] is then flash expanded through an appropriate expansion device, such as expansion valve 14, to slightly above the operating pressure (approximately 450 psia [3,103 kPa(a)]) of fractionation tower 19. During expansion a portion of the stream is vaporized, resulting in cooling of the total stream. In the process illustrated in FIG. 1, the expanded stream 35*b* leaving expansion valve 14 reaches a temperature of −123° F. [−86° C.]. The expanded stream 35*b* is warmed to −78° F. [−61° C.] and further vaporized in heat exchanger 21 as it provides cooling and partial condensation of vapor distillation stream 37 rising from the fractionation stages of fractionation tower 19. The warmed stream 35*c* is then supplied at an upper mid-point feed position in deethanizing section 19*b* of fractionation tower 19.

The remaining 58% of the vapor from separator 11 (stream 36) enters a work expansion machine 15 in which mechanical energy is extracted from this portion of the high pressure feed. The machine 15 expands the vapor substantially isentropically from a pressure of about 1278 psia [8,812 kPa(a)] to the tower operating pressure, with the work expansion cooling the expanded stream 36*a* to a temperature of approximately −57° F. [−49° C.]. The typical commercially available expanders are capable of recovering on the order of 80–85% of the work theoretically available in an ideal isentropic expansion. The work recovered is often used to drive a centrifugal compressor (such as item 16) that can be used to re-compress the tower overhead gas (stream 49), for example. The expanded and partially condensed stream 36*a* is supplied as feed to distillation column 19 at a lower mid-column feed point. Stream 40, the remaining portion of the separator liquid (stream 33) is flash expanded to slightly above the operating pressure of deethanizer 19 by expansion valve 12, cooling stream 40 to −14° F. [−26° C.] (stream 40*a*) before it provides cooling to the incoming feed gas as described earlier. Stream 40*b*, now at 75° F. [24° C.], then enters deethanizer 19 at a second lower mid-column feed point.

The deethanizer in fractionation tower 19 is a conventional distillation column containing a plurality of vertically spaced trays, one or more packed beds, or some combination of trays and packing. As is often the case in natural gas processing plants, the fractionation tower may consist of two sections. The upper section 19*a* is a separator wherein the top feed is divided into its respective vapor and liquid portions, and wherein the vapor rising from the lower distillation or deethanizing section 19*b* is combined with the vapor portion (if any) of the top feed to form the deethanizer overhead vapor (stream 37) which exits the top of the tower. The lower, deethanizing section 19*b* contains the trays and/or packing and provides the necessary contact between the liquids falling downward and the vapors rising upward. The deethanizing section also includes one or more reboilers (such as reboiler 20) which heat and vaporize a portion of the liquids flowing down the column to provide the stripping vapors which flow up the column. The liquid product stream 41 exits the bottom of the tower at 213° F. [101° C.], based on a typical specification of an ethane to propane ratio of 0.020:1 on a molar basis in the bottom product.

The overhead distillation stream 37 leaves deethanizer 19 at −73° F. [−59° C.] and is cooled and partially condensed in reflux condenser 21 as described earlier. The partially condensed stream 37*a* enters reflux drum 22 at −94° F. [−70° C.] where the condensed liquid (stream 44) is separated from the uncondensed vapor (stream 43). The condensed liquid (stream 44) is pumped by pump 23 to a top feed point on deethanizer 19 as reflux stream 44*a*.

Figure 2:
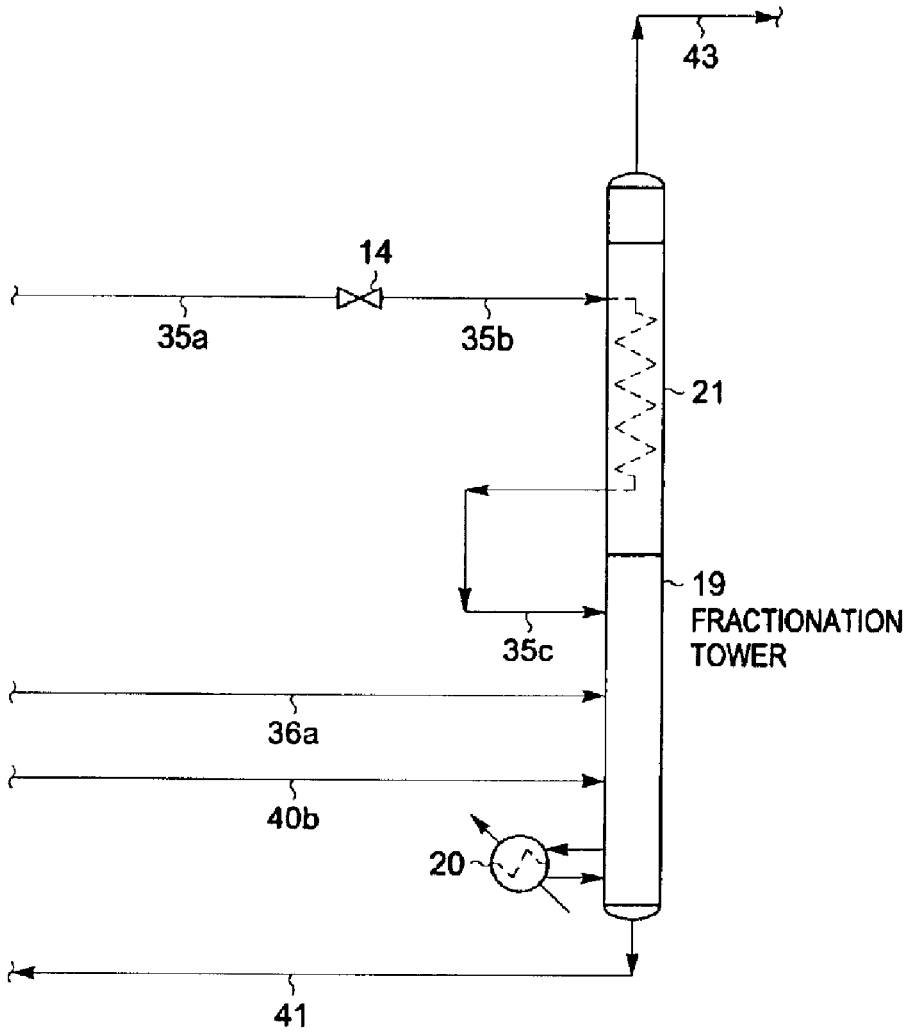
FIGS. 2 and 3 are diagrams of alternative fractionation systems which may be employed in the process of the present invention.
Figure 3:
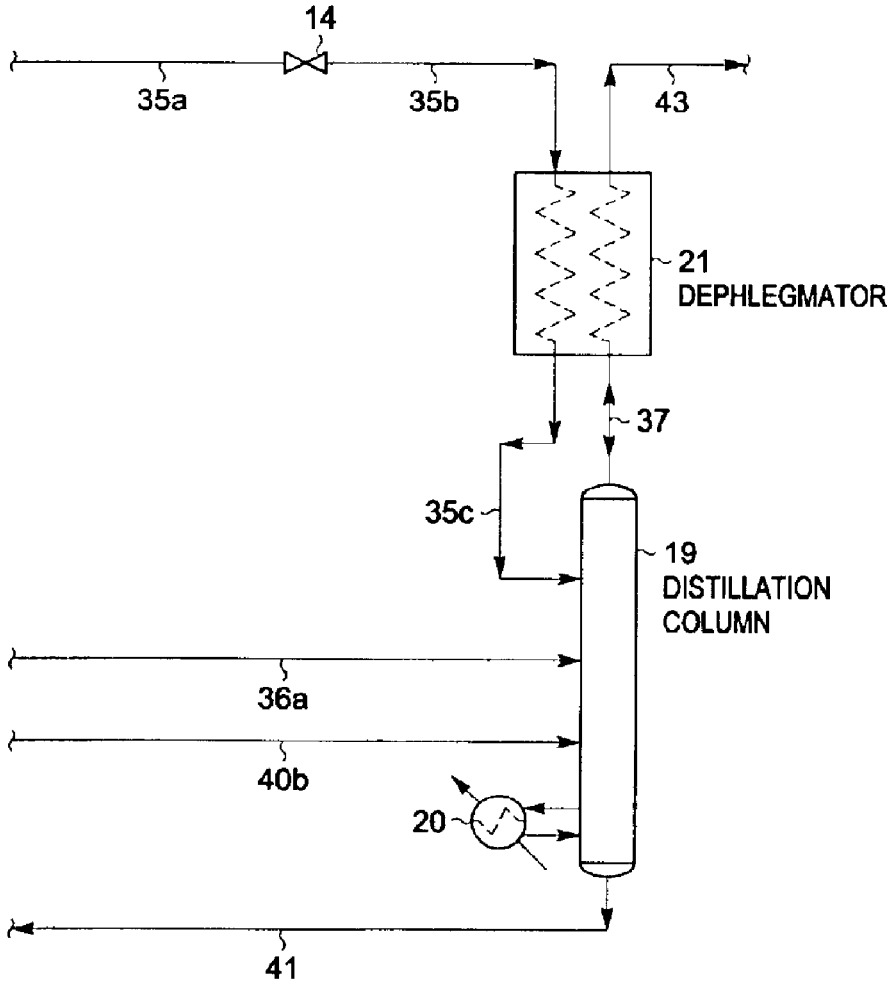

When the deethanizing section forms the lower portion of a fractionation tower, reflux condenser 21 may be located inside the tower above column 19 as shown in FIG. 2. This eliminates the need for reflux drum 22 and reflux pump 23 because the distillation stream is then both cooled and separated in the tower above the fractionation stages of the column. Alternatively, use of a dephlegmator (such as dephlegmator 21 in FIG. 3) in place of reflux condenser 21 in FIG. 1 eliminates the reflux drum and reflux pump and also provides concurrent fractionation stages to replace those in the upper section of the deethanizer column. If the dephlegmator is positioned in a plant at grade level, it is connected to a vapor/liquid separator and the liquid collected in the separator is pumped to the top of the distillation column. The decision as to whether to include the reflux condenser inside the column or to use a dephlegmator usually depends on plant side and heat exchanger surface requirements.

The uncondensed vapor (stream 43) from reflux drum 22 is warmed to 93° F. [34° C.] in heat exchanger 24, and a portion (stream 48) is then withdrawn to serve as fuel gas for the plant. (The amount of fuel gas that must be withdrawn is largely determined by the fuel required for the engines and/or turbines driving the gas compressors in the plant, such as refrigerant compressors 64, 66, and 68 in this example.) The remainder of the warmed vapor (stream 49) is compressed by compressor 16 driven by expansion machines 15, 61, and 63. After cooling to 100° F. [38° C.] in discharge cooler 25, stream 49*b* is further cooled to −83° F. [−64° C.] in heat exchanger 24 by cross exchange with the cold vapor, stream 43.

Stream 49*c* then enters heat exchanger 60 and is further cooled by refrigerant stream 71*d* to −255° F. [−160° C.] to condense and subcool it, whereupon it enters a work expansion machine 61 in which mechanical energy is extracted from the stream. The machine 61 expands liquid stream 49*d* substantially isentropically from a pressure of about 593 psia [4,085 kPa(a)] to the LNG storage pressure (15.5 psia [107 kPa(a)]), slightly above atmospheric pressure. The work expansion cools the expanded stream 49*e* to a temperature of approximately −256° F. [−160° C.], whereupon it is then directed to the LNG storage tank 62 which holds the LNG product (stream 50).

All of the cooling for streams 35 and 49*c* is provided by a closed cycle refrigeration loop. The working fluid for this cycle is a mixture of hydrocarbons and nitrogen, with the composition of the mixture adjusted as needed to provide the required refrigerant temperature while condensing at a reasonable pressure using the available cooling medium. In this case, condensing with cooling water has been assumed, so a refrigerant mixture composed of nitrogen, methane, ethane, propane, and heavier hydrocarbons is used in the simulation of the FIG. 1 process. The composition of the stream, in approximate mole percent, is 8.7% nitrogen, 31.7% methane, 47.0% ethane, and 8.6% propane, with the balance made up of heavier hydrocarbons.

The refrigerant stream 71 leaves discharge cooler 69 at 100° F. [38° C.] and 607 psia [4,185 kPa(a)]. It enters heat exchanger 10 and is cooled to −34° F. [−37° C.] and partially condensed by the partially warmed expanded refrigerant stream 71*f* and by other refrigerant streams. For the FIG. 1 simulation, it has been assumed that these other refrigerant streams are commercial-quality propane refrigerant at three different temperature and pressure levels. The partially condensed refrigerant stream 71*a* then enters heat exchanger 13 for further cooling to −90° F. [−68° C.] by partially warmed expanded refrigerant stream 71*e*, further condensing the refrigerant (stream 71*b*). The refrigerant is condensed and then subcooled to −255° F. [−160° C.] in heat exchanger 60 by expanded refrigerant stream 71*d*. The subcooled liquid stream 71*c* enters a work expansion machine 63 in which mechanical energy is extracted from the stream as it is expanded substantially isentropically from a pressure of about 586 psia [4,040 kPa(a)] to about 34 psia [234 kPa(a)]. During expansion a portion of the stream is vaporized, resulting in cooling of the total stream to −264° F. [−164° C.] (stream 71*d*). The expanded stream 71*d* then reenters heat exchangers 60, 13, and 10 where it provides cooling to stream 49*c*, stream 35, and the refrigerant (streams 71, 71*a*, and 71*b*) as it is vaporized and superheated.

The superheated refrigerant vapor (stream 71*g*) leaves heat exchanger 10 at 90° F. [32° C.] and is compressed in three stages to 617 psia [4,254 kPa(a)]. Each of the three compression stages (refrigerant compressors 64, 66, and 68) is driven by a supplemental power source and is followed by a cooler (discharge coolers 65, 67, and 69) to remove the heat of compression. The compressed stream 71 from discharge cooler 69 returns to heat exchanger 10 to complete the cycle.

A summary of stream flow rates and energy consumption for the process illustrated in FIG. 1 is set forth in the following table:

TABLE I (FIG. 1)
Stream Flow Summary - Lb. Moles/Hr [kg moles/Hr]

| Stream | Methane | Ethane | Propane | Butanes+ | Total |
|---|---|---|---|---|---|
| 31 | 40,977 | 3,861 | 2,408 | 1,404 | 48,656 |
| 32 | 40,193 | 3,667 | 2,171 | 1,087 | 47,123 |
| 33 | 784 | 194 | 237 | 317 | 1,533 |
| 34 | 16,680 | 1,522 | 901 | 451 | 19,556 |
| 36 | 23,513 | 2,145 | 1,270 | 636 | 27,567 |
| 37 | 44,843 | 7,065 | 120 | 0 | 52,035 |
| 40 | 784 | 194 | 237 | 317 | 1,533 |
| 41 | 0 | 48 | 2,385 | 1,404 | 3,837 |
| 43 | 40,977 | 3,813 | 23 | 0 | 44,819 |
| 44 | 3,866 | 3,252 | 97 | 0 | 7,216 |
| 48 | 2,527 | 235 | 1 | 0 | 2,765 |
| 50 | 38,450 | 3,578 | 22 | 0 | 42,054 |

| | | | |
|---|---|---|---|
| Recoveries in LPG* | | | |
| Propane | 99.05% | | |
| Butanes+ | 100.00% | | |
| Production Rate | 197,031 | Lb/Hr | [197,031 kg/Hr] |
| LNG Product | | | |
| Production Rate | 725,522 | Lb/Hr | [725,522 kg/Hr] |
| Purity* | 91.43% | | |
| Lower Heating Value | 970.4 | BTU/SCF | [36.16 MJ/m$^3$] |
| Power | | | |
| Refrigerant Compression | 90,714 | HP | [149,132 kW] |
| Propane Compression | 36,493 | HP | [59,994 kW] |
| Total Compression | 127,207 | HP | [209,126 kW] |
| Utility Heat | | | |
| Demethanizer Reboiler | 58,003 | MBTU/Hr | [37,470 kW] |

*(Based on un-rounded flow rates)

The efficiency of LNG production processes is typically compared using the "specific power consumption" required, which is the ratio of the total refrigeration compression power to the total liquid production rate. Published information on the specific power consumption for prior art processes for producing LNG indicates a range of 0.168 HP-Hr/Lb [0.276 kW-Hr/kg] to 0.182 HP-Hr/Lb [0.300 kW-Hr/kg], which is believed to be based on an on-stream factor of 340 days per year for the LNG production plant. On this same basis, the specific power consumption for the FIG. 1 embodiment of the present invention is 0.148 HP-Hr/Lb [0.243 kW-Hr/kg], which gives an efficiency improvement of 14–23% over the prior art processes.

Figure 4:
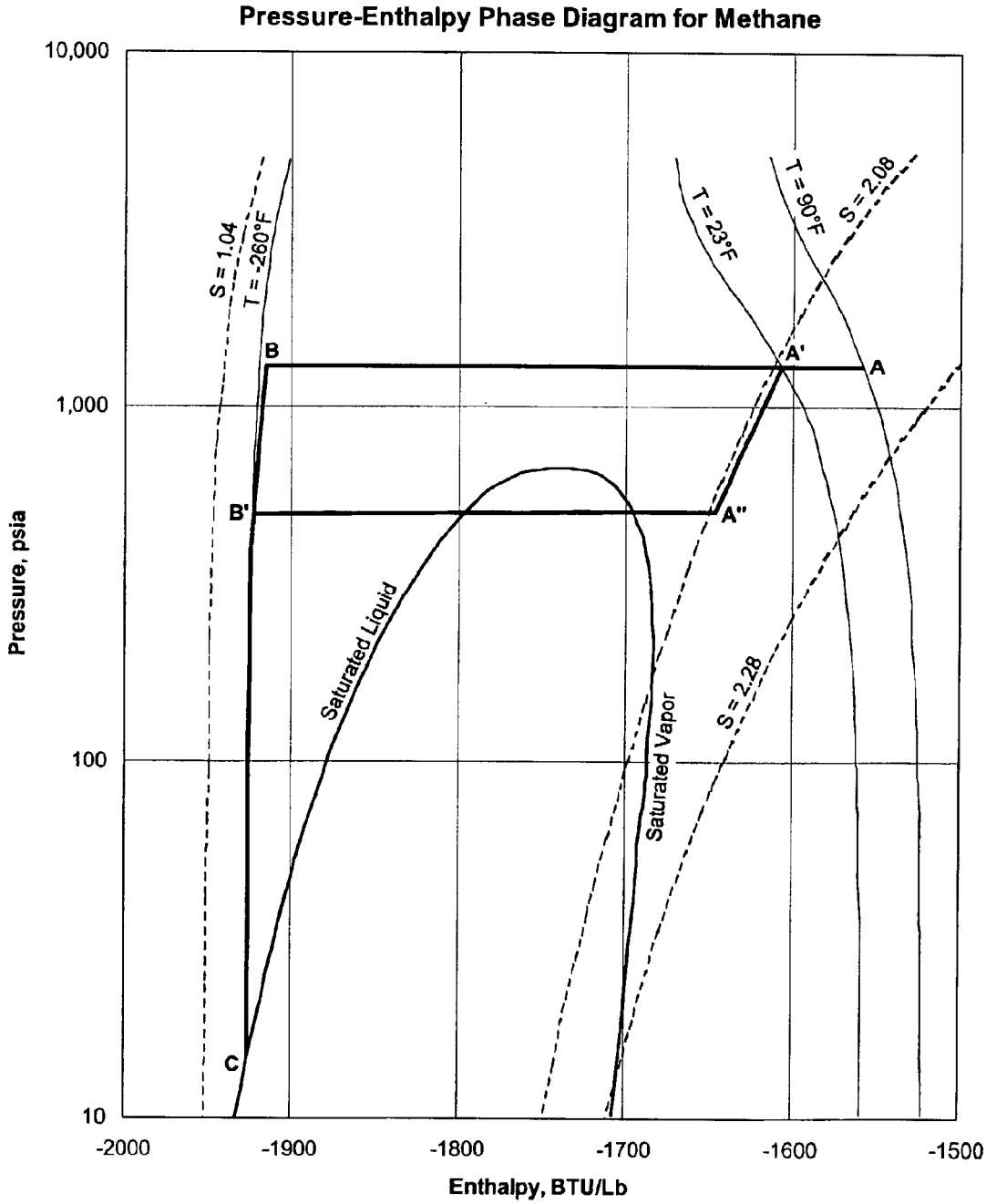
FIG. 4 is a pressure-enthalpy phase diagram for methane used to illustrate the advantages of the present invention over prior art processes.
Figure 5:
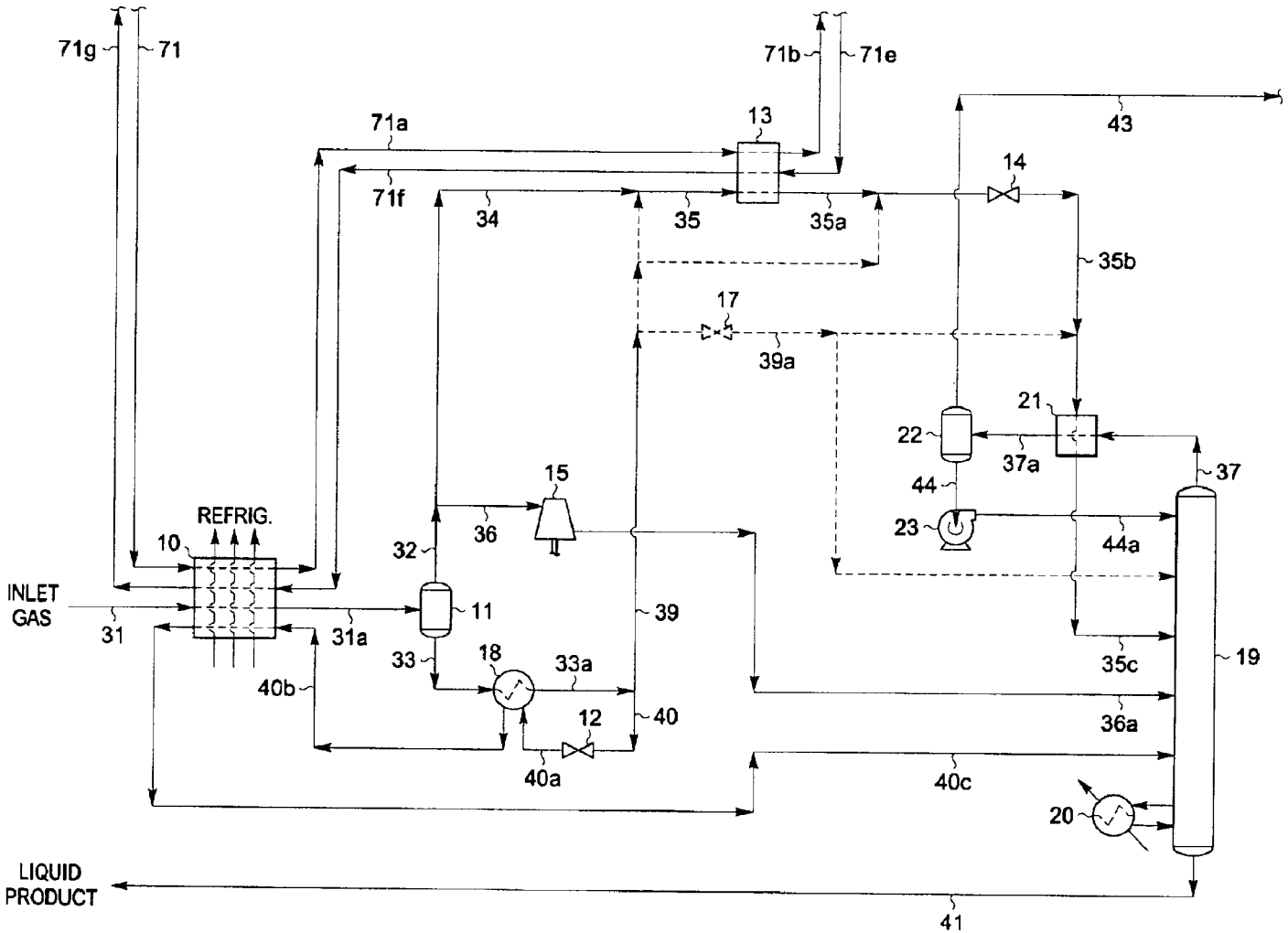
FIGS. 5, 6, 7, 8, 9, and 10 are flow diagrams of alternative natural gas liquefaction plants adapted for co-production of a liquid stream in accordance with the present invention.

There are two primary factors that account for the improved efficiency of the present invention. The first factor can be understood by examining the thermodynamics of the liquefaction process when applied to a high pressure gas stream such as that considered in this example. Since the primary constituent of this stream is methane, the thermodynamic properties of methane can be used for the purposes of comparing the liquefaction cycle employed in the prior art processes versus the cycle used in the present invention. FIG. 4 contains a pressure-enthalpy phase diagram for methane. In most of the prior art liquefaction cycles, all cooling of the gas stream is accomplished while the stream is at high pressure (path A–B), whereupon the stream is then expanded (path B–C) to the pressure of the LNG storage vessel (slightly above atmospheric pressure). This expansion step may employ a work expansion machine, which is typically capable of recovering on the order of 75–80% of the work theoretically available in an ideal isentropic expansion. In the interest of simplicity, fully isentropic expansion is displayed in FIG. 4 for path B–C. Even so, the enthalpy reduction provided by this work expansion is quite small, because the lines of constant entropy are nearly vertical in the liquid region of the phase diagram.

Contrast this now with the liquefaction cycle of the present invention. After partial cooling at high pressure (path A–A'), the gas stream is work expanded (path A'–A") to an intermediate pressure. (Again, fully isentropic expansion is displayed in the interest of simplicity.) The remainder of the cooling is accomplished at the intermediate pressure (path A"–B'), and the stream is then expanded (path B'–C) to the pressure of the LNG storage vessel. Since the lines of constant entropy slope less steeply in the vapor region of the phase diagram, a significantly larger enthalpy reduction is provided by the first work expansion step (path A'–A") of the present invention. Thus, the total amount of cooling required for the present invention (the sum of paths A–A' and A"-B') is less than the cooling required for the prior art processes (path A–B), reducing the refrigeration (and hence the refrigeration compression) required to liquefy the gas stream.

The second factor accounting for the improved efficiency of the present invention is the superior performance of hydrocarbon distillation systems at lower operating pressures. The hydrocarbon removal step in most of the prior art processes is performed at high pressure, typically using a scrub column that employs a cold hydrocarbon liquid as the absorbent stream to remove the heavier hydrocarbons from the incoming gas stream. Operating the scrub column at high pressure is not very efficient, as it results in the co-absorption of a significant fraction of the methane and ethane from the gas stream, which must subsequently be stripped from the absorbent liquid and cooled to become part of the LNG product. In the present invention, the hydrocarbon removal step is conducted at the intermediate pressure where the vapor-liquid equilibrium is much more favorable, resulting in very efficient recovery of the desired heavier hydrocarbons in the co-product liquid stream.

Other Embodiments

One skilled in the art will recognize that the present invention can be adapted for use with all types of LNG liquefaction plants to allow co-production of an NGL stream, an LPG stream, or a condensate stream, as best suits the needs at a given plant location. Further, it will be recognized that a variety of process configurations may be employed for recovering the liquid co-product stream. The present invention can be adapted to recover an NGL stream containing a significant fraction of the $C_2$ components present in the feed gas, or to recover a condensate stream containing only the $C_4$ and heavier components present in the feed gas, rather than producing an LPG co-product as described earlier.

FIG. 1 represents the preferred embodiment of the present invention for the processing conditions indicated. FIGS. 5 through 10 depict alternative embodiments of the present invention that may be considered for a particular application. Depending on the quantity of heavier hydrocarbons in the feed gas and the feed gas pressure, the cooled feed stream 31*a* leaving heat exchanger 10 may not contain any liquid (because it is above its dewpoint, or because it is above its cricondenbar), so that separator 11 shown in FIGS. 1 and 6 through 10 is not required, and the cooled feed stream can flow directly to an appropriate expansion device, such as work expansion machine 15. In instances where the inlet gas is richer than that heretofore described, an embodiment of the present invention such as that shown in FIG. 5 may be employed. Condensed liquid stream 33 flows through heat exchanger 18 and is subcooled, then divided into two portions. The first portion (stream 40) flows through expansion valve 12 where it undergoes expansion for flash vaporization as the pressure is reduced to about the pressure of distillation column 19. The cold stream 40*a* from expansion valve 12 then flows through heat exchanger 18 where it is partially warmed as it is used to subcool stream 33 as described earlier. Partially warmed stream 40*b* is then further warmed in heat exchanger 10 and flows to a lower mid-point feed location on fractionation column 19. The second liquid portion (stream 39), still at high pressure, is (1) combined with portion 34 of the vapor stream from separator 11, or (2) combined with substantially condensed stream 35*a*, or (3) expanded in expansion valve 17 and thereafter either supplied to fractionation column 19 at an upper mid-point feed location or combined with expanded stream 35*b*. Alternatively, portions of stream 39 may follow any or all of the flow paths heretofore described and depicted in FIG. 5.

Figure 6:
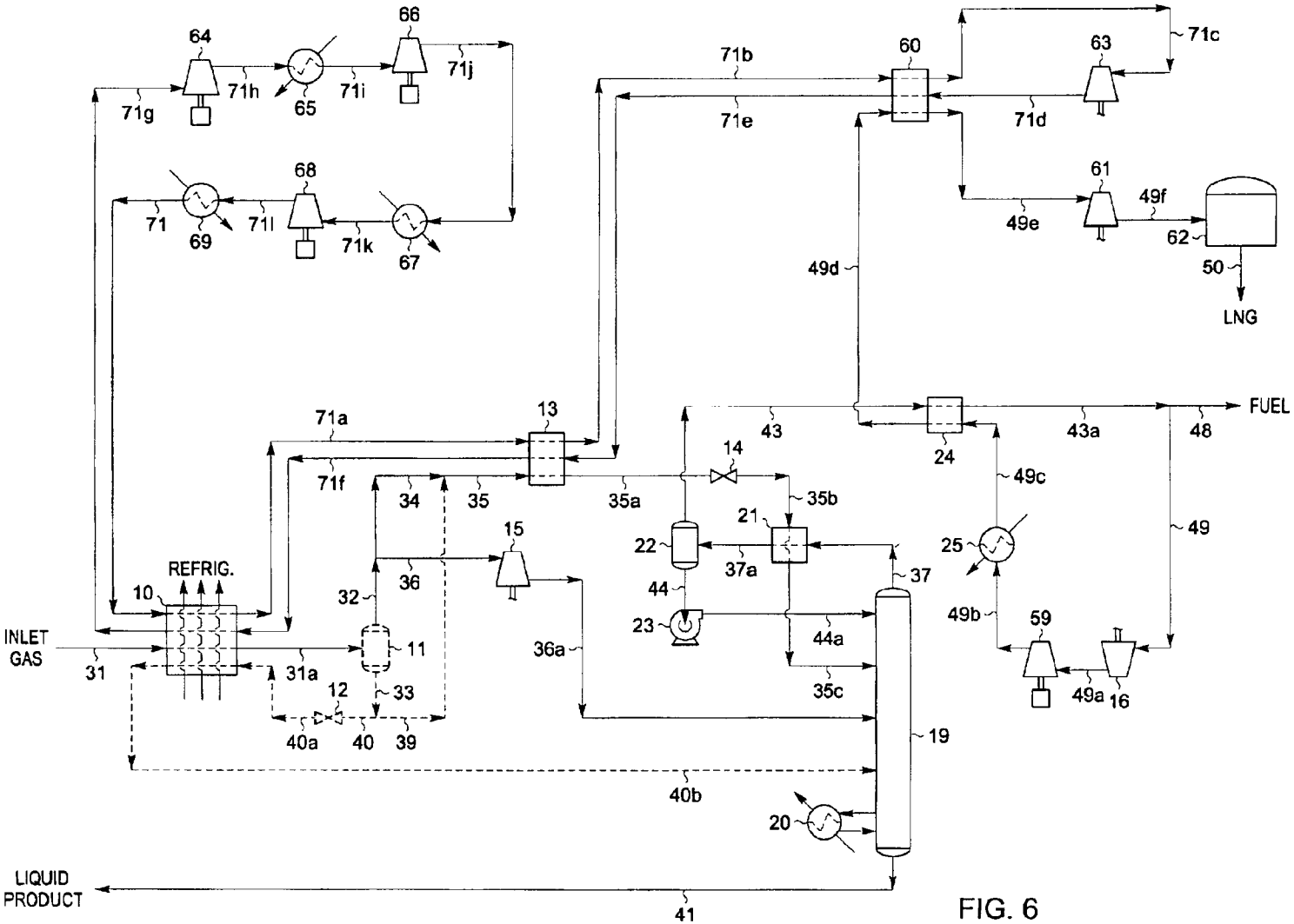
Figure 7:
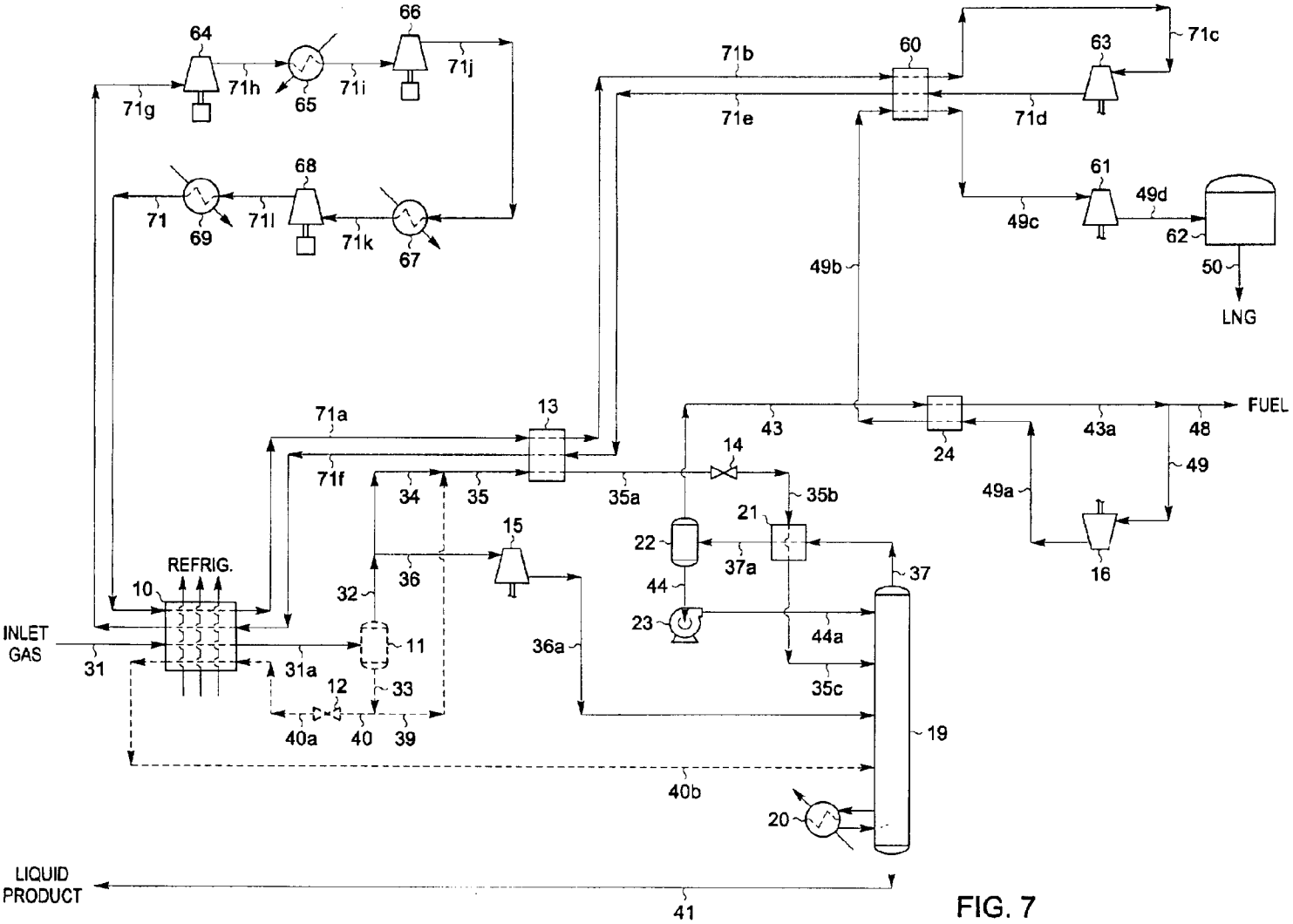
Figure 8:
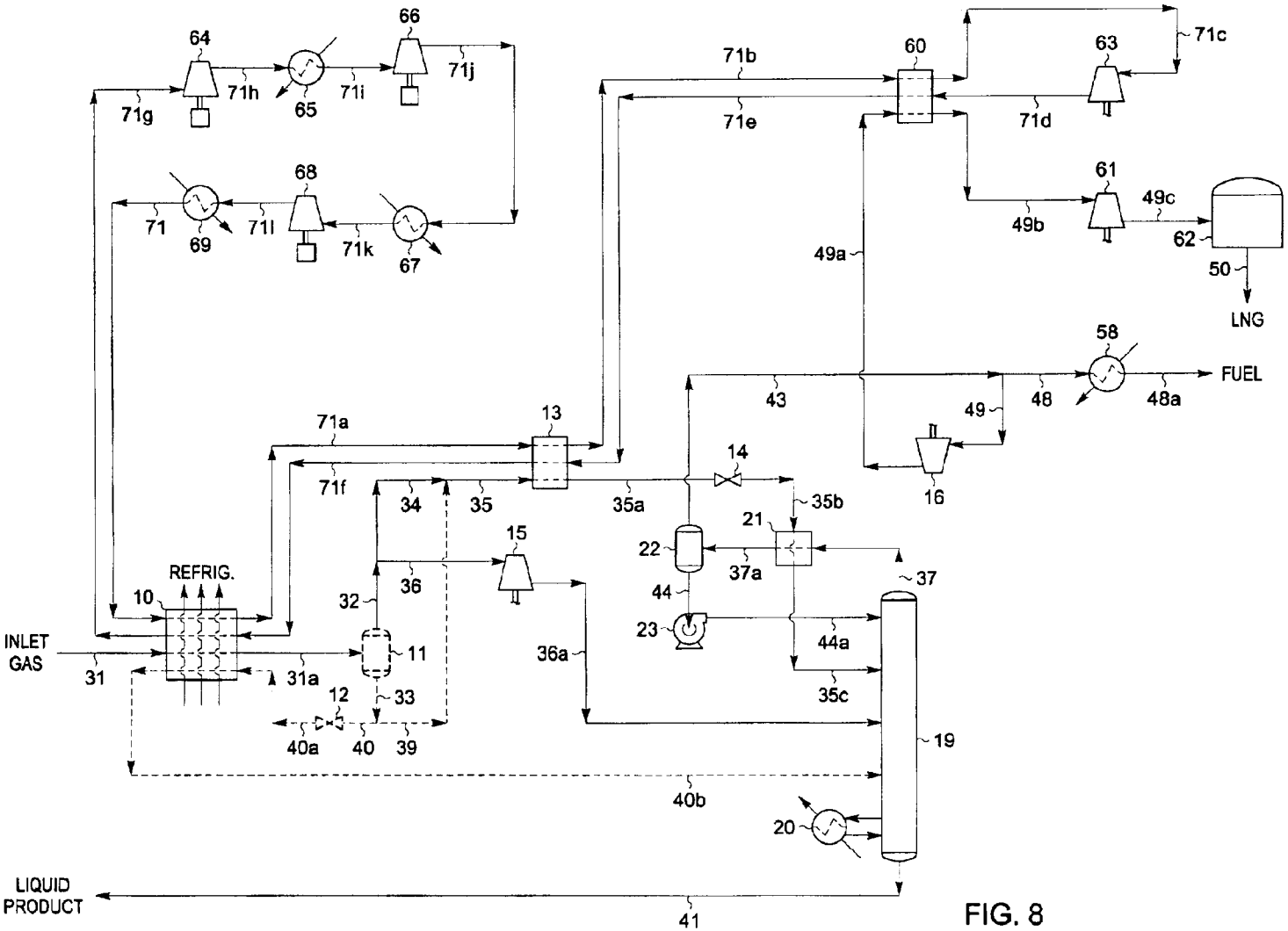
Figure 9:
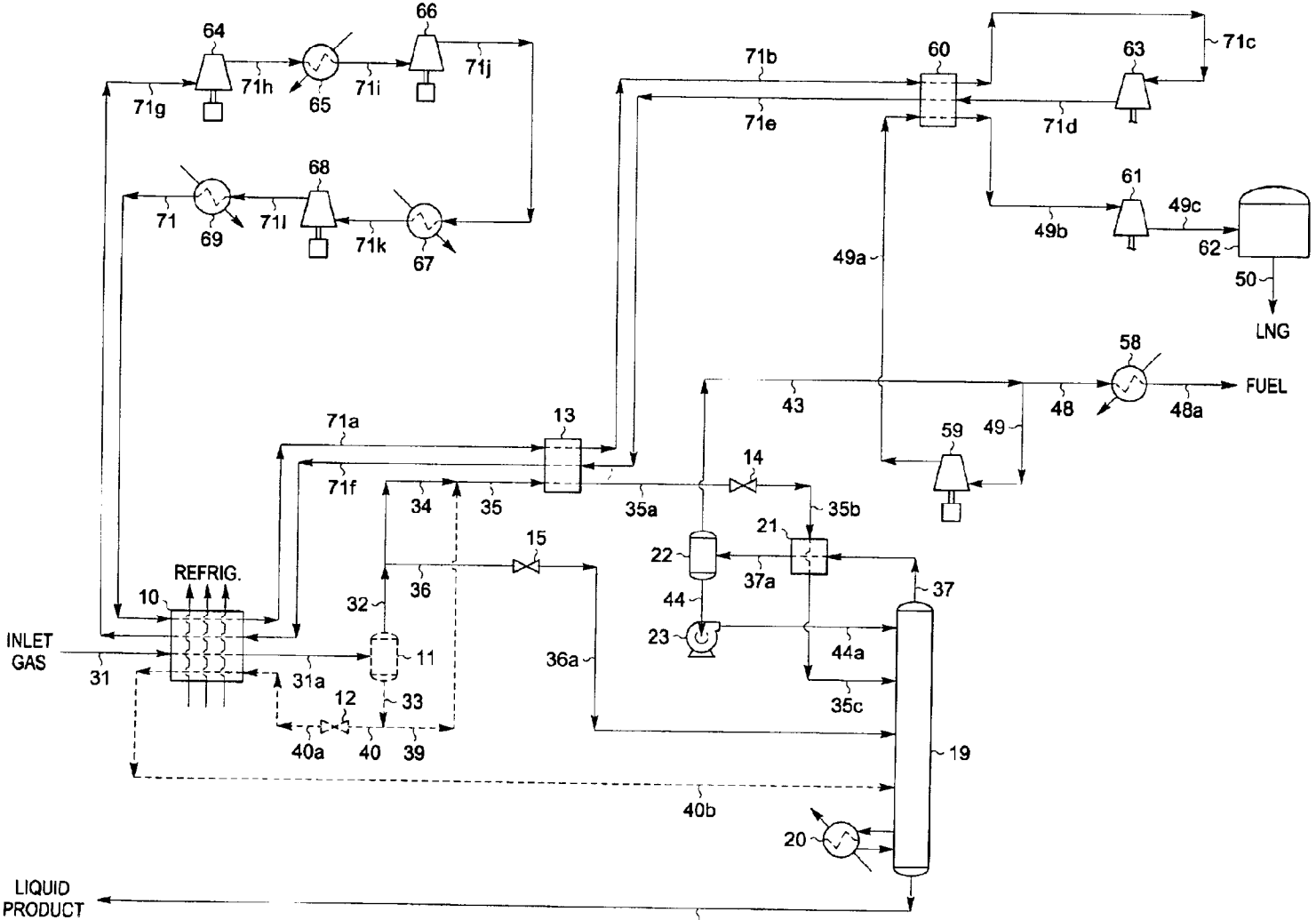
Figure 10:
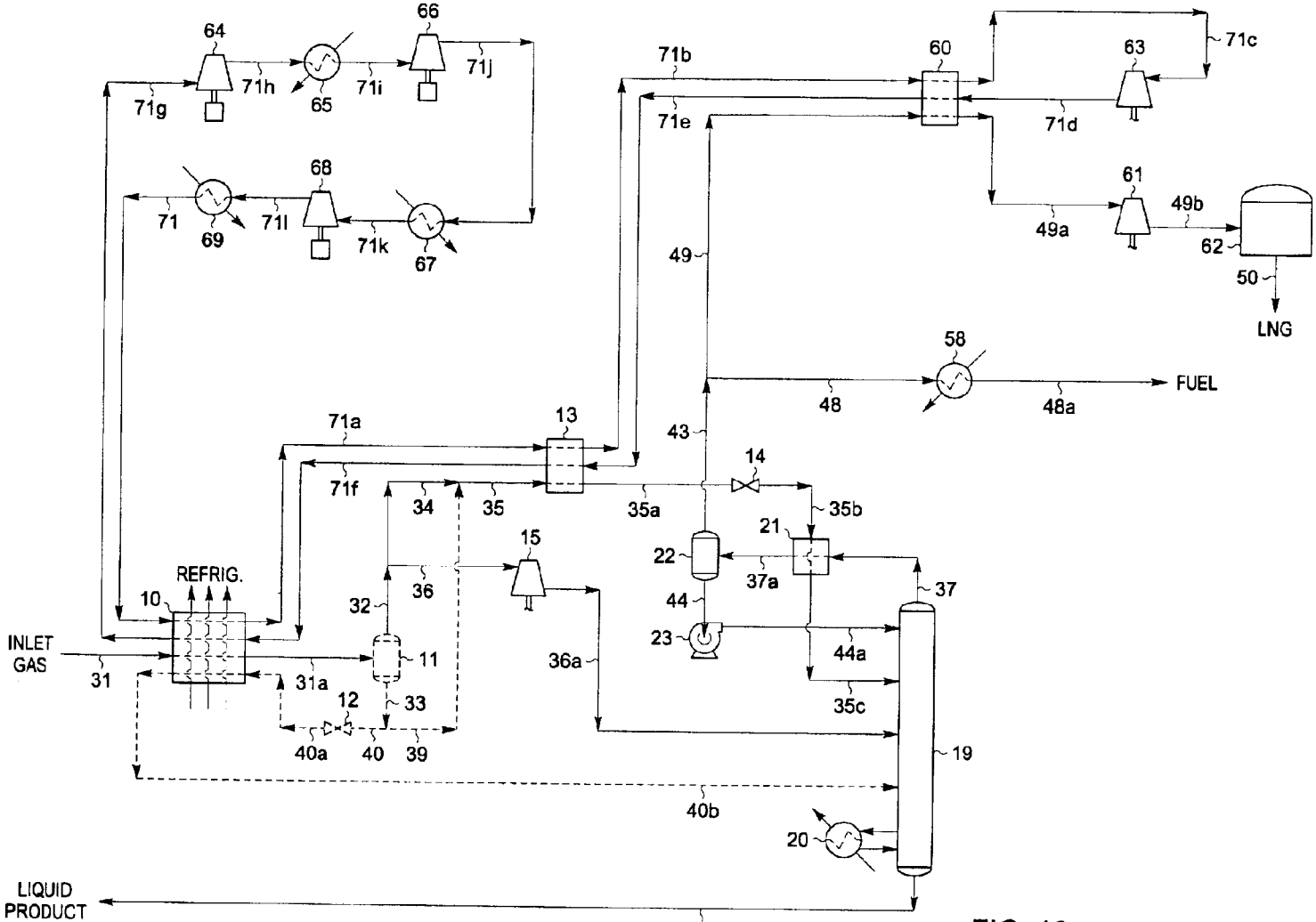

The disposition of the gas stream remaining after recovery of the liquid co-product stream (stream 43 in FIGS. 1 and 6 through 10) before it is supplied to heat exchanger 60 for condensing and subcooling may be accomplished in many ways. In the process of FIG. 1, the stream is heated, compressed to higher pressure using energy derived from one or more work expansion machines, partially cooled in a discharge cooler, then further cooled by cross exchange with the original stream. As shown in FIG. 6, some applications may favor compressing the stream to higher pressure, using supplemental compressor 59 driven by an external power source for example. As shown by the dashed equipment (heat exchanger 24 and discharge cooler 25) in FIG. 1, some circumstances may favor reducing the capital cost of the facility by reducing or eliminating the pre-cooling of the compressed stream before it enters heat exchanger 60 (at the expense of increasing the cooling load on heat exchanger 60 and increasing the power consumption of refrigerant compressors 64, 66, and 68). In such cases, stream 49*a* leaving the compressor may flow directly to heat exchanger 24 as shown in FIG. 7, or flow directly to heat exchanger 60 as shown in FIG. 8. If work expansion machines are not used for expansion of any portions of the high pressure feed gas, a compressor driven by an external power source, such as compressor 59 shown in FIG. 9, may be used in lieu of compressor 16. Other circumstances may not justify any compression of the stream at all, so that the stream flows directly to heat exchanger 60 as shown in FIG. 10 and by the dashed equipment (heat exchanger 24, compressor 16, and discharge cooler 25) in FIG. 1. If heat exchanger 24 is not included to heat the stream before the plant fuel gas (stream 48) is withdrawn, a supplemental heater 58 may be needed to warm the fuel gas before it is consumed, using a utility stream or another process stream to supply the necessary heat, as shown in FIGS. 8 through 10. Choices such as these must generally be evaluated for each application, as factors such as gas composition, plant size, desired co-product stream recovery level, and available equipment must all be considered.

In accordance with the present invention, the cooling of the inlet gas stream and the feed stream to the LNG production section may be accomplished in many ways. In the processes of FIGS. 1 and 5 through 10, inlet gas stream 31 is cooled and condensed by external refrigerant streams and flashed separator liquids. However, the cold process streams could also be used to supply some of the cooling to the high pressure refrigerant (stream 71*a*). Further, any stream at a temperature colder than the stream(s) being cooled may be utilized. For instance, a side draw of vapor from fractionation tower 19 could be withdrawn and used for cooling. The use and distribution of tower liquids and/or vapors for process heat exchange, and the particular arrangement of heat exchangers for inlet gas and feed gas cooling, must be evaluated for each particular application, as well as the choice of process streams for specific heat exchange services. The selection of a source of cooling will depend on a number of factors including, but not limited to, feed gas composition and conditions, plant size, heat exchanger size, potential cooling source temperature, etc. One skilled in the art will also recognize that any combination of the above cooling sources or methods of cooling may be employed in combination to achieve the desired feed stream temperature(s).

Further, the supplemental external refrigeration that is supplied to the inlet gas stream and the feed stream to the LNG production section may also be accomplished in many different ways. In FIGS. 1 and 6 through 10, boiling single-component refrigerant has been assumed for the high level external refrigeration and vaporizing multi-component refrigerant has been assumed for the low level external refrigeration, with the single-component refrigerant used to pre-cool the multi-component refrigerant stream. Alternatively, both the high level cooling and the low level cooling could be accomplished using single-component refrigerants with successively lower boiling points (i.e., "cascade refrigeration"), or one single-component refrigerant at successively lower evaporation pressures. As another alternative, both the high level cooling and the low level cooling could be accomplished using multi-component refrigerant streams with their respective compositions adjusted to provide the necessary cooling temperatures. The selection of the method for providing external refrigeration will depend on a number of factors including, but not limited to, feed gas composition and conditions, plant size, compressor driver size, heat exchanger size, ambient heat sink temperature, etc. One skilled in the art will also recognize that any combination of the methods for providing external refrigeration described above may be employed in combination to achieve the desired feed stream temperature(s).

Subcooling of the condensed liquid stream leaving heat exchanger 60 (stream 49*d* in FIG. 1, stream 49*e* in FIG., 6, stream 49*c* in FIG. 7, stream 49*b* in FIGS. 8 and 9, and stream 49*a* in FIG. 10) reduces or eliminates the quantity of flash vapor that may be generated during expansion of the stream to the operating pressure of LNG storage tank 62. This generally reduces the specific power consumption for producing the LNG by eliminating the need for flash gas compression. However, some circumstances may favor reducing the capital cost of the facility by reducing the size of heat exchanger 60 and using flash gas compression or other means to dispose of any flash gas that may be generated.

Although individual stream expansion is depicted in particular expansion devices, alternative expansion means may be employed where appropriate. For example, conditions may warrant work expansion of the substantially condensed feed stream (stream 35*a* in FIGS. 1 and 5 through 10). Further, isenthalpic flash expansion may be used in lieu of work expansion for the subcooled liquid stream leaving heat exchanger 60 (stream 49*d* in FIG. 1, stream 49*e* in FIG. 6, stream 49*c* in FIG. 7, stream 49*b* in FIGS. 8 and 9, and stream 49*a* in FIG. 10), but will necessitate either more subcooling in heat exchanger 60 to avoid forming flash vapor in the expansion, or else adding flash vapor compression or other means for disposing of the flash vapor that results. Similarly, isenthalpic flash expansion may be used in lieu of work expansion for the subcooled high pressure refrigerant stream leaving heat exchanger 60 (stream 71*c* in FIGS. 1 and 6 through 10), with the resultant increase in the power consumption for compression of the refrigerant.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. In a process for liquefying a natural gas stream containing methane and heavier hydrocarbon components wherein (a) said natural gas stream is cooled under pressure to condense at least a portion of it and form a condensed stream; and (b) said condensed stream is expanded to lower pressure to form said liquefied natural gas stream;

the improvement wherein (1) said natural gas stream is treated in one or more cooling steps;

(2) said cooled natural gas stream is divided into at least a first gaseous stream and a second gaseous stream;

(3) said first gaseous stream is cooled to condense substantially all of it and thereafter expanded to an intermediate pressure;

(4) said expanded substantially condensed first gaseous stream is directed in heat exchange relation with a more volatile vapor distillation stream which rises from fractionation stages of a distillation column and is thereby warmed;

(5) said second gaseous stream is expanded to said intermediate pressure;

(6) said warmed expanded first gaseous stream and said expanded second gaseous stream are directed into said distillation column wherein said streams are separated into said more volatile vapor distillation stream and a relatively less volatile fraction containing a major portion of said heavier hydrocarbon components;

(7) said more volatile vapor distillation stream is cooled by said expanded substantially condensed first gaseous stream sufficiently to partially condense it and is thereafter separated to form a volatile residue gas fraction containing a major portion of said methane and lighter components and a reflux stream;

(8) said reflux stream is directed into said distillation column as a top feed thereto; and (9) said volatile residue gas fraction is cooled under pressure to condense at least a portion of it and form thereby said condensed stream.

2. In a process for liquefying a natural gas stream containing methane and heavier hydrocarbon components wherein (a) said natural gas stream is cooled under pressure to condense at least a portion of it and form a condensed stream; and (b) said condensed stream is expanded to lower pressure to form said liquefied natural gas stream;

the improvement wherein (1) said natural gas stream is treated in one or more cooling steps to partially condense it;

(2) said partially condensed natural gas stream is separated to provide thereby a vapor stream and a liquid stream;

(3) said vapor stream is divided into at least a first gaseous stream and a second gaseous stream;

(4) said first gaseous stream is cooled to condense substantially all of it and thereafter expanded to an intermediate pressure;

(5) said expanded substantially condensed first gaseous stream is directed in heat exchange relation with a more volatile vapor distillation stream which rises from fractionation stages of a distillation column and is thereby warmed;

(6) said second gaseous stream is expanded to said intermediate pressure;

(7) said liquid stream is expanded to said intermediate pressure;

(8) said warmed expanded first gaseous stream, said expanded second gaseous stream, and said expanded liquid stream are directed into said distillation column wherein said streams are separated into said more volatile vapor distillation stream and a relatively less volatile fraction containing a major portion of said heavier hydrocarbon components;

(9) said more volatile vapor distillation stream is cooled by said expanded substantially condensed first gaseous stream sufficiently to partially condense it and is thereafter separated to form a volatile residue gas fraction containing a major portion of said methane and lighter components and a reflux stream;

(10) said reflux stream is directed into said distillation column as a top feed thereto; and

(11) said volatile residue gas fraction is cooled under pressure to condense at least a portion of it and form thereby said condensed stream.

3. In a process for liquefying a natural gas stream containing methane and heavier hydrocarbon components wherein (a) said natural gas stream is cooled under pressure to condense at least a portion of it and form a condensed stream; and (b) said condensed stream is expanded to lower pressure to form said liquefied natural gas stream;

the improvement wherein (1) said natural gas stream is treated in one or more cooling steps to partially condense it;

(2) said partially condensed natural gas stream is separated to provide thereby a vapor stream and a liquid stream;

(3) said vapor stream is divided into at least a first gaseous stream and a second gaseous stream;

(4) said first gaseous stream is combined with at least a portion of said liquid stream, forming thereby a combined stream;

(5) said combined stream is cooled to condense substantially all of it and thereafter expanded to an intermediate pressure;

(6) said expanded substantially condensed combined stream is directed in heat exchange relation with a more volatile vapor distillation stream which rises from fractionation stages of a distillation column and is thereby warmed;

(7) said second gaseous stream is expanded to said intermediate pressure;

(8) any remaining portion of said liquid stream is expanded to said intermediate pressure;

(9) said warmed expanded combined stream, said expanded second gaseous stream, and said expanded remaining portion of said liquid stream are directed into said distillation column wherein said streams are separated into said more volatile vapor distillation stream and a relatively less volatile fraction containing a major portion of said heavier hydrocarbon components;

(10) said more volatile vapor distillation stream is cooled by said expanded substantially condensed combined stream sufficiently to partially condense it and is thereafter separated to form a volatile residue gas fraction containing a major portion of said methane and lighter components and a reflux stream;

(11) said reflux stream is directed into said distillation column as a top feed thereto; and

(12) said volatile residue gas fraction is cooled under pressure to condense at least a portion of it and form thereby said condensed stream.

4. In a process for liquefying a natural gas stream containing methane and heavier hydrocarbon components wherein (a) said natural gas stream is cooled under pressure to condense at least a portion of it and form a condensed stream; and (b) said condensed stream is expanded to lower pressure to form said liquefied natural gas stream;

the improvement wherein (1) said natural gas stream is treated in one or more cooling steps to partially condense it;

(2) said partially condensed natural gas stream is separated to provide thereby a vapor stream and a liquid stream;

(3) said vapor stream is divided into at least a first gaseous stream and a second gaseous stream;

(4) said first gaseous stream is cooled to condense substantially all of it and thereafter expanded to an intermediate pressure;

(5) said expanded substantially condensed first gaseous stream is directed in heat exchange relation with a more volatile vapor distillation stream which rises from fractionation stages of a distillation column and is thereby warmed;

(6) said second gaseous stream is expanded to said intermediate pressure;

(7) said liquid stream is cooled and thereafter divided into at least a first portion and a second portion;

(8) said first portion is expanded to said intermediate pressure and thereafter warmed;

(9) said second portion is expanded to said intermediate pressure;

(10) said warmed expanded first gaseous stream, said expanded second gaseous stream, said warmed expanded first portion, and said expanded second portion are directed into said distillation column wherein said streams are separated into said more volatile vapor distillation stream and a relatively less volatile fraction containing a major portion of said heavier hydrocarbon components;

(11) said more volatile vapor distillation stream is cooled by said expanded substantially condensed first gaseous stream sufficiently to partially condense it and is thereafter separated to form a volatile residue gas fraction containing a major portion of said methane and lighter components and a reflux stream;

(12) said reflux stream is directed into said distillation column as a top feed thereto; and

(13) said volatile residue gas fraction is cooled under pressure to condense at least a portion of it and form thereby said condensed stream.

5. In a process for liquefying a natural gas stream containing methane and heavier hydrocarbon components wherein (a) said natural gas stream is cooled under pressure to condense at least a portion of it and form a condensed stream; and (b) said condensed stream is expanded to lower pressure to form said liquefied natural gas stream;

the improvement wherein (1) said natural gas stream is treated in one or more cooling steps to partially condense it;

(2) said partially condensed natural gas stream is separated to provide thereby a vapor stream and a liquid stream;

(3) said vapor stream is divided into at least a first gaseous stream and a second gaseous stream;

(4) said first gaseous stream is cooled to condense substantially all of it;

(5) said liquid stream is cooled and thereafter divided into at least a first portion and a second portion;

(6) said first portion is expanded to an intermediate pressure and thereafter warmed;

(7) said second portion is combined with said substantially condensed first gaseous stream, forming thereby a combined stream, whereupon said combined stream is expanded to said intermediate pressure;

(8) said expanded combined stream is directed in heat exchange relation with a more volatile vapor distillation stream which rises from fractionation stages of a distillation column and is thereby warmed;

(9) said second gaseous stream is expanded to said intermediate pressure;

(10) said warmed expanded combined stream, said expanded second gaseous stream, and said warmed expanded first portion are directed into said distillation column wherein said streams are separated into said more volatile vapor distillation stream and a relatively less volatile fraction containing a major portion of said heavier hydrocarbon components;

(11) said more volatile vapor distillation stream is cooled by said expanded combined stream sufficiently to partially condense it and is thereafter separated to form a volatile residue gas fraction containing a major portion of said methane and lighter components and a reflux stream;

(12) said reflux stream is directed into said distillation column as a top feed thereto; and

(13) said volatile residue gas fraction is cooled under pressure to condense at least a portion of it and form thereby said condensed stream.

6. The improvement according to claim 1 wherein said distillation column is a lower section of a fractionation tower and wherein said more volatile vapor distillation stream is cooled sufficiently to partially condense it in a portion of said tower above said distillation column and concurrently separated to form said volatile residue gas fraction and said reflux stream, whereupon said reflux stream flows to the top fractionation stage of said distillation column.

7. The improvement according to claim 2 wherein said distillation column is a lower section of a fractionation tower and wherein said more volatile vapor distillation stream is cooled sufficiently to partially condense it in a portion of said tower above said distillation column and concurrently separated to form said volatile residue gas fraction and said reflux stream, whereupon said reflux stream flows to the top fractionation stage of said distillation column.

8. The improvement according to claim 3 wherein said distillation column is a lower section of a fractionation tower and wherein said more volatile vapor distillation stream is cooled sufficiently to partially condense it in a portion of said tower above said distillation column and concurrently separated to form said volatile residue gas fraction and said reflux stream, whereupon said reflux stream flows to the top fractionation stage of said distillation column.

9. The improvement according to claim 4 wherein said distillation column is a lower section of a fractionation tower and wherein said more volatile vapor distillation stream is cooled sufficiently to partially condense it in a portion of said tower above said distillation column and concurrently separated to form said volatile residue gas fraction and said reflux stream, whereupon said reflux stream flows to the top fractionation stage of said distillation column.

10. The improvement according to claim 5 wherein said distillation column is a lower section of a fractionation tower and wherein said more volatile vapor distillation stream is cooled sufficiently to partially condense it in a portion of said tower above said distillation column and concurrently separated to form said volatile residue gas fraction and said reflux stream, whereupon said reflux stream flows to the top fractionation stage of said distillation column.

11. The improvement according to claim 1 wherein said more volatile vapor distillation stream is cooled sufficiently to partially condense it in a dephlegmator and concurrently separated to form said volatile residue gas fraction and said reflux stream, whereupon said reflux stream flows from the dephlegmator to the top fractionation stage of said distillation column.

12. The improvement according to claim 2 wherein said more volatile vapor distillation stream is cooled sufficiently to partially condense it in a dephlegmator and concurrently separated to form said volatile residue gas fraction and said reflux stream, whereupon said reflux stream flows from the dephlegmator to the top fractionation stage of said distillation column.

13. The improvement according to claim 3 wherein said more volatile vapor distillation stream is cooled sufficiently to partially condense it in a dephlegmator and concurrently separated to form said volatile residue gas fraction and said reflux stream, whereupon said reflux stream flows from the dephlegmator to the top fractionation stage of said distillation column.

14. The improvement according to claim 4 wherein said more volatile vapor distillation stream is cooled sufficiently to partially condense it in a dephlegmator and concurrently separated to form said volatile residue gas fraction and said reflux stream, whereupon said reflux stream flows from the dephlegmator to the top fractionation stage of said distillation column.

15. The improvement according to claim 5 wherein said more volatile vapor distillation stream is cooled sufficiently to partially condense it in a dephlegmator and concurrently separated to form said volatile residue gas fraction and said reflux stream, whereupon said reflux stream flows from the dephlegmator to the top fractionation stage of said distillation column.

16. The improvement according to claim 1, 2, 3, 4, 5, 6, 7, 8, 9, 10, 11, 12, 13, 14, or 15 wherein said volatile residue gas fraction is compressed and thereafter cooled under pressure to condense at least a portion of it and form thereby said condensed stream.

17. The improvement according to claim 1, 2, 3, 4, 5, 6, 7, 8, 9, 10, 11, 12, 13, 14, or 15 wherein said volatile residue gas fraction is heated, compressed, and thereafter cooled under pressure to condense at least a portion of it and form thereby said condensed stream.

18. The improvement according to claim 1, 2, 3, 4, 5, 6, 7, 8, 9, 10, 11, 12, 13, 14, or 15 wherein said volatile residue gas fraction contains a major portion of said methane, lighter components, and $C_2$ components.

19. The improvement according to claim 16 wherein said volatile residue gas fraction contains a major portion of said methane, lighter components, and $C_2$ components.

20. The improvement according to claim 17 wherein said volatile residue gas fraction contains a major portion of said methane, lighter components, and $C_2$ components.

21. The improvement according to claim 1, 2, 3, 4, 5, 6, 7, 8, 9, 10, 11, 12, 13, 14, or 15 wherein said volatile residue gas fraction contains a major portion of said methane, lighter components, $C_2$ components, and $C_3$ components.

22. The improvement according to claim 16 wherein said volatile residue gas fraction contains a major portion of said methane, lighter components, $C_2$ components, and $C_3$ components.

23. The improvement according to claim 17 wherein said volatile residue gas fraction contains a major portion of said methane, lighter components, $C_2$ components, and $C_3$ components.

24. An apparatus for the liquefaction of a natural gas stream containing methane and heavier hydrocarbon components, which includes (1) one or more first heat exchange means to receive said natural gas stream and cool it under pressure;

(2) dividing means connected to said first heat exchange means to receive said cooled natural gas stream and divide it into at least a first gaseous stream and a second gaseous stream;

(3) second heat exchange means connected to said dividing means to receive said first gaseous stream and to cool it sufficiently to substantially condense it;

(4) first expansion means connected to said second heat exchange means to receive said substantially condensed first gaseous stream and expand it to an intermediate pressure;

(5) third heat exchange means connected to said first expansion means to receive said expanded substantially condensed first gaseous stream and heat it, said third heat exchange means being further connected to a distillation column to receive a more volatile vapor distillation stream rising from fractionation stages of said distillation column and cool it sufficiently to partially condense it;

(6) second expansion means connected to said dividing means to receive said second gaseous stream and expand it to said intermediate pressure;

(7) said distillation column being further connected to said third heat exchange means and said second expansion means to receive said heated expanded first gaseous stream and said expanded second gaseous stream, with said distillation column adapted to separate said streams into said more volatile vapor distillation stream and a relatively less volatile fraction containing a major portion of said heavier hydrocarbon components;

(8) separation means connected to said third heat exchange means to receive said cooled partially condensed distillation stream and separate it into a volatile residue gas fraction containing a major portion of said methane and lighter components and a reflux stream, said separation means being further connected to said distillation column to direct said reflux stream into said distillation column as a top feed thereto;

(9) fourth heat exchange means connected to said separation means to receive said volatile residue gas fraction, with said fourth heat exchange means adapted to cool said volatile residue gas fraction under pressure to condense at least a portion of it and form thereby a condensed stream;

(10) third expansion means connected to said fourth heat exchange means to receive said condensed stream and expand it to lower pressure to form said liquefied natural gas stream; and

(11) control means adapted to regulate the quantities and temperatures of said feed streams to said distillation column to maintain the overhead temperature of said distillation column at a temperature whereby the major portion of said heavier hydrocarbon components is recovered in said relatively less volatile fraction.

25. An apparatus for the liquefaction of a natural gas stream containing methane and heavier hydrocarbon components, which includes (1) one or more first heat exchange means to receive said natural gas stream and cool it under pressure sufficiently to partially condense it;

(2) first separation means connected to said first heat exchange means to receive said partially condensed natural gas stream and separate it into a vapor stream and a liquid stream;

(3) dividing means connected to said first separation means to receive said vapor stream and divide it into at least a first gaseous stream and a second gaseous stream;

(4) second heat exchange means connected to said dividing means to receive said first gaseous stream and to cool it sufficiently to substantially condense it;

(5) first expansion means connected to said second heat exchange means to receive said substantially condensed first gaseous stream and expand it to an intermediate pressure;

(6) third heat exchange means connected to said first expansion means to receive said expanded substantially condensed first gaseous stream and heat it, said third heat exchange means being further connected to a distillation column to receive a more volatile vapor distillation stream rising from fractionation stages of said distillation column and cool it sufficiently to partially condense it;

(7) second expansion means connected to said dividing means to receive said second gaseous stream and expand it to said intermediate pressure;

(8) third expansion means connected to said first separation means to receive said liquid stream and expand it to said intermediate pressure;

(9) said distillation column being further connected to said third heat exchange means, said second expansion means, and said third expansion means to receive said heated expanded first gaseous stream, said expanded second gaseous stream, and said expanded liquid stream, with said distillation column adapted to separate said streams into said more volatile vapor distillation stream and a relatively less volatile fraction containing a major portion of said heavier hydrocarbon components;

(10) second separation means connected to said third heat exchange means to receive said cooled partially condensed distillation stream and separate it into a volatile residue gas fraction containing a major portion of said methane and lighter components and a reflux stream, said second separation means being further connected to said distillation column to direct said reflux stream into said distillation column as a top feed thereto;

(11) fourth heat exchange means connected to said second separation means to receive said volatile residue gas fraction, with said fourth heat exchange means adapted to cool said volatile residue gas fraction under pressure to condense at least a portion of it and form thereby a condensed stream;

(12) fourth expansion means connected to said fourth heat exchange means to receive said condensed stream and expand it to lower pressure to form said liquefied natural gas stream; and

(13) control means adapted to regulate the quantities and temperatures of said feed streams to said distillation column to maintain the overhead temperature of said distillation column at a temperature whereby the major portion of said heavier hydrocarbon components is recovered in said relatively less volatile fraction.

26. An apparatus for the liquefaction of a natural gas stream containing methane and heavier hydrocarbon components, which includes (1) one or more first heat exchange means to receive said natural gas stream and cool it under pressure sufficiently to partially condense it;

(2) first separation means connected to said first heat exchange means to receive said partially condensed natural gas stream and separate it into a vapor stream and a liquid stream;

(3) dividing means connected to said first separation means to receive said vapor stream and divide it into at least a first gaseous stream and a second gaseous stream;

(4) combining means connected to said dividing means and to said first separation means to receive said first gaseous stream and at least a portion of said liquid stream and form thereby a combined stream;

(5) second heat exchange means connected to said combining means to receive said combined stream and to cool it sufficiently to substantially condense it;

(6) first expansion means connected to said second heat exchange means to receive said substantially condensed combined stream and expand it to an intermediate pressure;

(7) third heat exchange means connected to said first expansion means to receive said expanded substantially condensed combined stream and heat it, said third heat exchange means being further connected to a distillation column to receive a more volatile vapor distillation stream rising from fractionation stages of said distillation column and cool it sufficiently to partially condense it;

(8) second expansion means connected to said dividing means to receive said second gaseous stream and expand it to said intermediate pressure;

(9) third expansion means connected to said first separation means to receive any remaining portion of said liquid stream and expand it to said intermediate pressure;

(10) said distillation column being further connected to said third heat exchange means, said second expansion means, and said third expansion means to receive said heated expanded combined stream, said expanded second gaseous stream, and said expanded remaining portion of said liquid stream, with said distillation column adapted to separate said streams into said more volatile vapor distillation stream and a relatively less volatile fraction containing a major portion of said heavier hydrocarbon components;

(11) second separation means connected to said third heat exchange means to receive said cooled partially condensed distillation stream and separate it into a volatile residue gas fraction containing a major portion of said methane and lighter components and a reflux stream, said second separation means being further connected to said distillation column to direct said reflux stream into said distillation column as a top feed thereto;

(12) fourth heat exchange means connected to said second separation means to receive said volatile residue gas fraction, with said fourth heat exchange means adapted to cool said volatile residue gas fraction under pressure to condense at least a portion of it and form thereby a condensed stream;

(13) fourth expansion means connected to said fourth heat exchange means to receive said condensed stream and expand it to lower pressure to form said liquefied natural gas stream; and

(14) control means adapted to regulate the quantities and temperatures of said feed streams to said distillation column to maintain the overhead temperature of said distillation column at a temperature whereby the major portion of said heavier hydrocarbon components is recovered in said relatively less volatile fraction.

27. An apparatus for the liquefaction of a natural gas stream containing methane and heavier hydrocarbon components, which includes (1) one or more first heat exchange means to receive said natural gas stream and cool it under pressure sufficiently to partially condense it;

(2) first separation means connected to said first heat exchange means to receive said partially condensed natural gas stream and separate it into a vapor stream and a liquid stream;

(3) second heat exchange means connected to said first separation means to receive said liquid stream and cool it;

(4) first dividing means connected to said second heat exchange means to receive said cooled liquid stream and divide it into at least a first portion and a second portion;

(5) first expansion means connected to said first dividing means to receive said first portion and expand it to an intermediate pressure, said first expansion means being further connected to supply said expanded first portion to said second heat exchange means, thereby heating said expanded first portion while cooling said liquid stream;

(6) second dividing means connected to said first separation means to receive said vapor stream and divide it into at least a first gaseous stream and a second gaseous stream;

(7) third heat exchange means connected to said second dividing means to receive said first gaseous stream and to cool it sufficiently to substantially condense it;

(8) second expansion means connected to said third heat exchange means to receive said substantially condensed first gaseous stream and expand it to said intermediate pressure;

(9) third expansion means connected to said second dividing means to receive said second gaseous stream and expand it to said intermediate pressure;

(10) fourth expansion means connected to said first dividing means to receive said second portion and expand it to said intermediate pressure;

(11) fourth heat exchange means connected to said second expansion means to receive said expanded substantially condensed first gaseous stream and heat it, said fourth heat exchange means being further connected to a distillation column to receive a more volatile vapor distillation stream rising from fractionation stages of said distillation column and cool it sufficiently to partially condense it;

(12) said distillation column being further connected to said fourth heat exchange means, said third expansion means, said fourth expansion means, and said second heat exchange means to receive said heated expanded first gaseous stream, said expanded second gaseous stream, said expanded second portion, and said heated expanded first portion, with said distillation column adapted to separate said streams into said more volatile vapor distillation stream and a relatively less volatile fraction containing a major portion of said heavier hydrocarbon components;

(13) second separation means connected to said fourth heat exchange means to receive said cooled partially condensed distillation stream and separate it into a volatile residue gas fraction containing a major portion of said methane and lighter components and a reflux stream, said second separation means being further connected to said distillation column to direct said reflux stream into said distillation column as a top feed thereto;

(14) fifth heat exchange means connected to said second separation means to receive said volatile residue gas fraction, with said fifth heat exchange means adapted to cool said volatile residue gas fraction under pressure to condense at least a portion of it and form thereby a condensed stream;

(15) fifth expansion means connected to said fifth heat exchange means to receive said condensed stream and expand it to lower pressure to form said liquefied natural gas stream; and

(16) control means adapted to regulate the quantities and temperatures of said feed streams to said distillation column to maintain the overhead temperature of said distillation column at a temperature whereby the major portion of said heavier hydrocarbon components is recovered in said relatively less volatile fraction.

28. An apparatus for the liquefaction of a natural gas stream containing methane and heavier hydrocarbon components, which includes (1) one or more first heat exchange means to receive said natural gas stream and cool it under pressure sufficiently to partially condense it;

(2) first separation means connected to said first heat exchange means to receive said partially condensed natural gas stream and separate it into a vapor stream and a liquid stream;

(3) second heat exchange means connected to said first separation means to receive said liquid stream and cool it;

(4) first dividing means connected to said second heat exchange means to receive said cooled liquid stream and divide it into at least a first portion and a second portion;

(5) first expansion means connected to said first dividing means to receive said first portion and expand it to an intermediate pressure, said first expansion means being further connected to supply said expanded first portion to said second heat exchange means, thereby heating said expanded first portion while cooling said liquid stream;

(6) second dividing means connected to said first separation means to receive said vapor stream and divide it into at least a first gaseous stream and a second gaseous stream;

(7) third heat exchange means connected to said second dividing means to receive said first gaseous stream and to cool it sufficiently to substantially condense it;

(8) combining means connected to said third heat exchange means and to said first dividing means to receive said substantially condensed first gaseous stream and said second portion and form thereby a combined stream;

(9) second expansion means connected to said combining means to receive said combined stream and expand it to said intermediate pressure;

(10) third expansion means connected to said second dividing means to receive said second gaseous stream and expand it to said intermediate pressure;

(11) fourth heat exchange means connected to said second expansion means to receive said expanded combined stream and heat it, said fourth heat exchange means being further connected to a distillation column to receive a more volatile vapor distillation stream rising from fractionation stages of said distillation column and cool it sufficiently to partially condense it;

(12) said distillation column being further connected to said fourth heat exchange means, said third expansion means, and said second heat exchange means to receive said heated expanded combined stream, said expanded second gaseous stream, and said heated expanded first portion, with said distillation column adapted to separate said streams into said more volatile vapor distillation stream and a relatively less volatile fraction containing a major portion of said heavier hydrocarbon components;

(13) second separation means connected to said fourth heat exchange means to receive said cooled partially condensed distillation stream and separate it into a volatile residue gas fraction containing a major portion of said methane and lighter components and a reflux stream, said second separation means being further connected to said distillation column to direct said reflux stream into said distillation column as a top feed thereto;

(14) fifth heat exchange means connected to said second separation means to receive said volatile residue gas fraction, with said fifth heat exchange means adapted to cool said volatile residue gas fraction under pressure to condense at least a portion of it and form thereby a condensed stream;

(15) fourth expansion means connected to said first fifth exchange means to receive said condensed stream and expand it to lower pressure to form said liquefied natural gas stream; and

(16) control means adapted to regulate the quantities and temperatures of said feed streams to said distillation column to maintain the overhead temperature of said distillation column at a temperature whereby the major portion of said heavier hydrocarbon components is recovered in said relatively less volatile fraction.

29. The apparatus according to claim 24 wherein (1) said distillation column is a lower section of a fractionation tower and wherein said more volatile vapor distillation stream is cooled sufficiently to partially condense it in a section of said fractionation tower above said distillation column and concurrently separated to form said volatile residue gas fraction and said reflux stream, whereupon said reflux stream flows to the top fractionation stage of said distillation column; and (2) said fourth heat exchange means is connected to said fractionation tower to receive said volatile residue gas fraction, with said fourth heat exchange means adapted to cool said volatile residue gas fraction under pressure to condense at least a portion of it and form thereby said condensed stream.

30. The apparatus according to claim 25 wherein (1) said distillation column is a lower section of a fractionation tower and wherein said more volatile vapor distillation stream is cooled sufficiently to partially condense it in a section of said fractionation tower above said distillation column and concurrently separated to form said volatile residue gas fraction and said reflux stream, whereupon said reflux stream flows to the top fractionation stage of said distillation column; and (2) said fourth heat exchange means is connected to said fractionation tower to receive said volatile residue gas fraction, with said fourth heat exchange means adapted to cool said volatile residue gas fraction under pressure to condense at least a portion of it and form thereby said condensed stream.

31. The apparatus according to claim 26 wherein (1) said distillation column is a lower section of a fractionation tower and wherein said more volatile vapor distillation stream is cooled sufficiently to partially condense it in a section of said fractionation tower above said distillation column and concurrently separated to form said volatile residue gas fraction and said reflux stream, whereupon said reflux stream flows to the top fractionation stage of said distillation column; and (2) said fourth heat exchange means is connected to said fractionation tower to receive said volatile residue gas fraction, with said fourth heat exchange means adapted to cool said volatile residue gas fraction under pressure to condense at least a portion of it and form thereby said condensed stream.

32. The apparatus according to claim 27 wherein (1) said distillation column is a lower section of a fractionation tower and wherein said more volatile vapor distillation stream is cooled sufficiently to partially condense it in a section of said fractionation tower above said distillation column and concurrently separated to form said volatile residue gas fraction and said reflux stream, whereupon said reflux stream flows to the top fractionation stage of said distillation column; and (2) said fifth heat exchange means is connected to said fractionation tower to receive said volatile residue gas fraction, with said fifth heat exchange means adapted to cool said volatile residue gas fraction under pressure to condense at least a portion of it and form thereby said condensed stream.

33. The apparatus according to claim 28 wherein (1) said distillation column is a lower section of a fractionation tower and wherein said more volatile vapor distillation stream is cooled sufficiently to partially condense it in a section of said fractionation tower above said distillation column and concurrently separated to form said volatile residue gas fraction and said reflux stream, whereupon said reflux stream flows to the top fractionation stage of said distillation column; and (2) said fifth heat exchange means is connected to said fractionation tower to receive said volatile residue gas fraction, with said fifth heat exchange means adapted to cool said volatile residue gas fraction under pressure to condense at least a portion of it and form thereby said condensed stream.

34. The apparatus according to claim 24 wherein said apparatus includes (1) a dephlegmator connected to said first expansion means to receive said expanded substantially condensed first gaseous stream and heat it, said dephlegmator being further connected to said distillation column to receive said more volatile vapor distillation stream and cool it sufficiently to partially condense it and concurrently separate it to form said volatile residue gas fraction and said reflux stream, said dephlegmator being further connected to said distillation column to supply said heated expanded first gaseous stream as a feed thereto and said reflux stream as a top feed thereto; and (2) said fourth heat exchange means connected to said dephlegmator to receive said volatile residue gas fraction, with said fourth heat exchange means adapted to cool said volatile residue gas fraction under pressure to condense at least a portion of it and form thereby said condensed stream.

35. The apparatus according to claim 25 wherein said apparatus includes (1) a dephlegmator connected to said first expansion means to receive said expanded substantially condensed first gaseous stream and heat it, said dephlegmator being further connected to said distillation column to receive said more volatile vapor distillation stream and cool it sufficiently to partially condense it and concurrently separate it to form said volatile residue gas fraction and said reflux stream, said dephlegmator being further connected to said distillation column to supply said heated expanded first gaseous stream as a feed thereto and said reflux stream as a top feed thereto; and (2) said fourth heat exchange means connected to said dephlegmator to receive said volatile residue gas fraction, with said fourth heat exchange means adapted to cool said volatile residue gas fraction under pressure to condense at least a portion of it and form thereby said condensed stream.

36. The apparatus according to claim 26 wherein said apparatus includes (1) a dephlegmator connected to said first expansion means to receive said expanded substantially condensed combined stream and heat it, said dephlegmator being further connected to said distillation column to receive said more volatile vapor distillation stream and cool it sufficiently to partially condense it and concurrently separate it to form said volatile residue gas fraction and said reflux stream, said dephlegmator being further connected to said distillation column to supply said heated expanded combined stream as a feed thereto and said reflux stream as a top feed thereto; and (2) said fourth heat exchange means connected to said dephlegmator to receive said volatile residue gas fraction, with said fourth heat exchange means adapted to cool said volatile residue gas fraction under pressure to condense at least a portion of it and form thereby said condensed stream.

37. The apparatus according to claim 27 wherein said apparatus includes (1) a dephlegmator connected to said second expansion means to receive said expanded substantially condensed first gaseous stream and heat it, said dephlegmator being further connected to said distillation column to receive said more volatile vapor distillation stream and cool it sufficiently to partially condense it and concurrently separate it to form said volatile residue gas fraction and said reflux stream, said dephlegmator being further connected to said distillation column to supply said heated expanded first gaseous stream as a feed thereto and said reflux stream as a top feed thereto; and (2) said fifth heat exchange means connected to said dephlegmator to receive said volatile residue gas fraction, with said fifth heat exchange means adapted to cool said volatile residue gas fraction under pressure to condense at least a portion of it and form thereby said condensed stream.

38. The apparatus according to claim 28 wherein said apparatus includes (1) a dephlegmator connected to said second expansion means to receive said expanded combined stream and heat it, said dephlegmator being further connected to said distillation column to receive said more volatile vapor distillation stream and cool it sufficiently to partially condense it and concurrently separate it to form said volatile residue gas fraction and said reflux stream, said dephlegmator being further connected to said distillation column to supply said heated expanded combined stream as a feed thereto and said reflux stream as a top feed thereto; and (2) said fifth heat exchange means connected to said dephlegmator to receive said volatile residue gas fraction, with said fifth heat exchange means adapted to cool said volatile residue gas fraction under pressure to condense at least a portion of it and form thereby said condensed stream.

39. The apparatus according to claim 24 wherein said apparatus includes (1) compressing means connected to said separating means to receive said volatile residue gas fraction and compress it; and (2) said fourth heat exchange means connected to said compressing means to receive said compressed volatile residue gas fraction, with said fourth heat exchange means adapted to cool said compressed volatile residue gas fraction under pressure to condense at least a portion of it and form thereby said condensed stream.

40. The apparatus according to claim 25 or 26 wherein said apparatus includes (1) compressing means connected to said second separating means to receive said volatile residue gas fraction and compress it; and (2) said fourth heat exchange means connected to said compressing means to receive said compressed volatile residue gas fraction, with said fourth heat exchange means adapted to cool said compressed volatile residue gas fraction under pressure to condense at least a portion of it and form thereby said condensed stream.

41. The apparatus according to claim 27 or 28 wherein said apparatus includes (1) compressing means connected to said second separating means to receive said volatile residue gas fraction and compress it; and (2) said fifth heat exchange means connected to said compressing means to receive said compressed volatile residue gas fraction, with said fifth heat exchange means adapted to cool said compressed volatile residue gas fraction under pressure to condense at least a portion of it and form thereby said condensed stream.

42. The apparatus according to claim 29, 30, or 31 wherein said apparatus includes (1) compressing means connected to said fractionation tower to receive said volatile residue gas fraction and compress it; and (2) said fourth heat exchange means connected to said compressing means to receive said compressed volatile residue gas fraction, with said fourth heat exchange means adapted to cool said compressed volatile residue gas fraction under pressure to condense at least a portion of it and form thereby said condensed stream.

43. The apparatus according to claim 32 or 33 wherein said apparatus includes (1) compressing means connected to said fractionation tower to receive said volatile residue gas fraction and compress it; and (2) said fifth heat exchange means connected to said compressing means to receive said compressed volatile residue gas fraction, with said fifth heat exchange means adapted to cool said compressed volatile residue gas fraction under pressure to condense at least a portion of it and form thereby said condensed stream.

44. The apparatus according to claim 34, 35, or 36 wherein said apparatus includes (1) compressing means connected to said dephlegmator to receive said volatile residue gas fraction and compress it; and (2) said fourth heat exchange means connected to said compressing means to receive said compressed volatile residue gas fraction, with said fourth heat exchange means adapted to cool said compressed volatile residue gas fraction under pressure to condense at least a portion of it and form thereby said condensed stream.

45. The apparatus according to claim 37 or 38 wherein said apparatus includes (1) compressing means connected to said dephlegmator to receive said volatile residue gas fraction and compress it; and (2) said fifth heat exchange means connected to said compressing means to receive said compressed volatile residue gas fraction, with said fifth heat exchange means adapted to cool said compressed volatile residue gas fraction under pressure to condense at least a portion of it and form thereby said condensed stream.

46. The apparatus according to claim 24 wherein said apparatus includes (1) heating means connected to said separation means to receive said volatile residue gas fraction and heat it;

(2) compressing means connected to said heating means to receive said heated volatile residue gas fraction and compress it; and (3) said fourth heat exchange means connected to said compressing means to receive said compressed heated volatile residue gas fraction, with said fourth heat exchange means adapted to cool said compressed heated volatile residue gas fraction under pressure to condense at least a portion of it and form thereby said condensed stream.

47. The apparatus according to claim 25 or 26 wherein said apparatus includes (1) heating means connected to said second separation means to receive said volatile residue gas fraction and heat it;

(2) compressing means connected to said heating means to receive said heated volatile residue gas fraction and compress it; and (3) said fourth heat exchange means connected to said compressing means to receive said compressed heated volatile residue gas fraction, with said fourth heat exchange means adapted to cool said compressed heated volatile residue gas fraction under pressure to condense at least a portion of it and form thereby said condensed stream.

48. The apparatus according to claim 27 or 28 wherein said apparatus includes (1) heating means connected to said second separation means to receive said volatile residue gas fraction and heat it;

(2) compressing means connected to said heating means to receive said heated volatile residue gas fraction and compress it; and (3) said fifth heat exchange means connected to said compressing means to receive said compressed heated volatile residue gas fraction,with said fifth heat exchange means adapted to cool said compressed heated volatile residue gas fraction under pressure to condense at least a portion of it and form thereby said condensed stream.

49. The apparatus according to claim 29, 30, or 31 wherein said apparatus includes (1) heating means connected to said fractionation tower to receive said volatile residue gas fraction and heat it;

(2) compressing means connected to said heating means to receive said heated volatile residue gas fraction and compress it; and (3) said fourth heat exchange means connected to said compressing means to receive said compressed heated volatile residue gas fraction, with said fourth heat exchange means adapted to cool said compressed heated volatile residue gas fraction under pressure to condense at least a portion of it and form thereby said condensed stream.

50. The apparatus according to claim 32 or 33 wherein said apparatus includes (1) heating means connected to said fractionation tower to receive said volatile residue gas fraction and heat it;

(2) compressing means connected to said heating means to receive said heated volatile residue gas fraction and compress it; and (3) said fifth heat exchange means connected to said compressing means to receive said compressed heated volatile residue gas fraction, with said fifth heat exchange means adapted to cool said compressed heated volatile residue gas fraction under pressure to condense at least a portion of it and form thereby said condensed stream.

51. The apparatus according to claim 34, 35, or 36 wherein said apparatus includes (1) heating means connected to said dephlegmator to receive said volatile residue gas fraction and heat it;

(2) compressing means connected to said heating means to receive said heated volatile residue gas fraction and compress it; and (3) said fourth heat exchange means connected to said compressing means to receive said compressed heated volatile residue gas fraction, with said fourth heat exchange means adapted to cool said compressed heated volatile residue gas fraction under pressure to condense at least a portion of it and form thereby said condensed stream.

52. The apparatus according to claim 37 or 38 wherein said apparatus includes (1) heating means connected to said dephlegmator to receive said volatile residue gas fraction and heat it;

(2) compressing means connected to said heating means to receive said heated volatile residue gas fraction and compress it; and (3) said fifth heat exchange means connected to said compressing means to receive said compressed heated volatile residue gas fraction, with said fifth heat exchange means adapted to cool said compressed heated volatile residue gas fraction under pressure to condense at least a portion of it and form thereby said condensed stream.

53. The apparatus according to claim 24, 25, 26, 27, 28, 29, 30, 31, 32, 33, 34, 35, 36, 37, 38, 39, or 46 wherein said volatile residue gas fraction contains a major portion of said methane, lighter components, and $C_2$ components.

54. The apparatus according to claim 40 wherein said volatile residue gas fraction contains a major portion of said methane, lighter components, and $C_2$ components.

55. The apparatus according to claim 41 wherein said volatile residue gas fraction contains a major portion of said methane, lighter components, and $C_2$ components.

56. The apparatus according to claim 42 wherein said volatile residue gas fraction contains a major portion of said methane, lighter components, and $C_2$ components.

57. The apparatus according to claim 43 wherein said volatile residue gas fraction contains a major portion of said methane, lighter components, and $C_2$ components.

58. The apparatus according to claim 44 wherein said volatile residue gas fraction contains a major portion of said methane, lighter components, and $C_2$ components.

59. The apparatus according to claim 45 wherein said volatile residue gas fraction contains a major portion of said methane, lighter components, and $C_2$ components.

60. The apparatus according to claim 47 wherein said volatile residue gas fraction contains a major portion of said methane, lighter components, and $C_2$ components.

61. The apparatus according to claim 48 wherein said volatile residue gas fraction contains a major portion of said methane, lighter components, and $C_2$ components.

62. The apparatus according to claim 49 wherein said volatile residue gas fraction contains a major portion of said methane, lighter components, and $C_2$ components.

63. The apparatus according to claim 50 wherein said volatile residue gas fraction contains a major portion of said methane, lighter components, and $C_2$ components.

64. The apparatus according to claim 51 wherein said volatile residue gas fraction contains a major portion of said methane, lighter components, and $C_2$ components.

65. The apparatus according to claim 52 wherein said volatile residue gas fraction contains a major portion of said methane, lighter components, and $C_2$ components.

66. The apparatus according to claim 24, 25, 26, 27, 28, 29, 30, 31, 32, 33, 34, 35, 36, 37, 38, 39, or 46 wherein said volatile residue gas fraction contains a major portion of said methane, lighter components, $C_2$ components, and $C_3$ components.

67. The apparatus according to claim 40 wherein said volatile residue gas fraction contains a major portion of said methane, lighter components, $C_2$ components, and $C_3$ components.

68. The apparatus according to claim 41 wherein said volatile residue gas fraction contains a major portion of said methane, lighter components, $C_2$ components, and $C_3$ components.

69. The apparatus according to claim 42 wherein said volatile residue gas fraction contains a major portion of said methane, lighter components, $C_2$ components, and $C_3$ components.

70. The apparatus according to claim 43 wherein said volatile residue gas fraction contains a major portion of said methane, lighter components, $C_2$ components, and $C_3$ components.

71. The apparatus according to claim 44 wherein said volatile residue gas fraction contains a major portion of said methane, lighter components, $C_2$ components, and $C_3$ components.

72. The apparatus according to claim 45 wherein said volatile residue gas fraction contains a major portion of said methane, lighter components, $C_2$ components, and $C_3$ components.

73. The apparatus according to claim 47 wherein said volatile residue gas fraction contains a major portion of said methane, lighter components, $C_2$ components, and $C_3$ components.

74. The apparatus according to claim 48 wherein said volatile residue gas fraction contains a major portion of said methane, lighter components, $C_2$ components, and $C_3$ components.

75. The apparatus according to claim 49 wherein said volatile residue gas fraction contains a major portion of said methane, lighter components, $C_2$ components, and $C_3$ components.

76. The apparatus according to claim 50 wherein said volatile residue gas fraction contains a major portion of said methane, lighter components, $C_2$ components, and $C_3$ components.

77. The apparatus according to claim 51 wherein said volatile residue gas fraction contains a major portion of said methane, lighter components, $C_2$ components, and $C_3$ components.

78. The apparatus according to claim 52 wherein said volatile residue gas fraction contains a major portion of said methane, lighter components, $C_2$ components, and $C_3$ components.

* * * * *

UNITED STATES PATENT AND TRADEMARK OFFICE

CERTIFICATE OF CORRECTION

PATENT NO. : 6,945,075 B2
DATED : September 20, 2005
INVENTOR(S) : John D. Wilkinson et al.

It is certified that error appears in the above-identified patent and that said Letters Patent is hereby corrected as shown below:

Title page,
Item [75], Inventors, "Kyle T. Ceullar," should read -- Kyle T. Cuellar, --.

Column 21,
Line 22, "first fifth" should read -- fifth --.

Signed and Sealed this

Twenty-eighth Day of March, 2006

JON W. DUDAS
*Director of the United States Patent and Trademark Office*